US010072440B2

(12) United States Patent
Singh et al.

(10) Patent No.: US 10,072,440 B2
(45) Date of Patent: Sep. 11, 2018

(54) ELECTRIC STRIKE ASSEMBLY

(71) Applicant: Rutherford Controls International Corp., Cambridge (CA)

(72) Inventors: Mandeep Singh, Kitchener (CA); Ryan McMillan, Elmira (CA)

(73) Assignee: Dormakaba Canada Inc., Ontario (CA)

( * ) Notice: Subject to any disclaimer, the term of this patent is extended or adjusted under 35 U.S.C. 154(b) by 624 days.

(21) Appl. No.: 14/418,064

(22) PCT Filed: Jul. 30, 2013

(86) PCT No.: PCT/CA2013/050591
§ 371 (c)(1),
(2) Date: Jan. 28, 2015

(87) PCT Pub. No.: WO2014/019088
PCT Pub. Date: Feb. 6, 2014

(65) Prior Publication Data

US 2015/0167351 A1 Jun. 18, 2015

Related U.S. Application Data

(60) Provisional application No. 61/677,212, filed on Jul. 30, 2012.

(51) Int. Cl.
*E05B 15/02* (2006.01)
*E05B 47/00* (2006.01)
(Continued)

(52) U.S. Cl.
CPC ..... *E05B 47/0012* (2013.01); *E05B 47/0047* (2013.01); *E06B 1/52* (2013.01);
(Continued)

(58) Field of Classification Search
CPC ..... E05B 47/0047; Y10T 292/696
(Continued)

(56) References Cited

U.S. PATENT DOCUMENTS 3,134,253 A * 5/1964 O'Brien ..... E05B 43/005 292/341.16
3,354,677 A * 11/1967 Green ..... E05B 47/0046 292/341.16

(Continued)

FOREIGN PATENT DOCUMENTS

EP 1546495 A2 6/2005

OTHER PUBLICATIONS

International Search Report for corresponding International Application No. PCT/CA2013/050591.

*Primary Examiner* — Carlos Lugo
(74) *Attorney, Agent, or Firm* — Baker & Hostetler LLP

(57) ABSTRACT

An electric strike assembly includes a housing formed with a recessed portion, a keeper pivotally arranged in the recessed portion of the housing, the keeper having an abutment, an actuator assembly having an actuator and an actuator paddle, and a blocking element rotatably mounted in the recessed portion of the housing, wherein cooperation of the actuator paddle with the blocking element is controlled by rotation of the actuator and determines a locking condition of the keeper based on a rotational position of the blocking element with respect to the abutment. In accordance with other aspects of the present disclosure, a locking system includes a door assembly having a latch, a door frame for mounting the door assembly, and an electric strike assembly mounted in the door frame. A method of controlling access through a door includes providing an electric strike assembly in accordance with aspects of the present disclosure.

15 Claims, 26 Drawing Sheets

230

(51) Int. Cl.
*E06B 1/52* (2006.01)
*E05B 15/00* (2006.01)

(52) U.S. Cl.
CPC ..... *E05B 2047/0024* (2013.01); *E05B 2047/0037* (2013.01); *Y10T 292/696* (2015.04)

(58) Field of Classification Search
USPC ..... 292/341.15–341.17
See application file for complete search history.

(56) References Cited

U.S. PATENT DOCUMENTS 3,640,560 A * 2/1972 Zawadzki ..... E05B 47/0047 292/201
3,774,422 A * 11/1973 Hogan ..... E05B 47/0047 292/341.16
4,211,443 A 7/1980 Butts et al.
4,815,776 A * 3/1989 Fuss ..... E05B 47/0047 292/341.16
5,076,625 A * 12/1991 Oxley ..... E05B 47/0047 292/201
5,088,779 A * 2/1992 Weiss ..... E05B 47/0047 292/201
5,681,070 A * 10/1997 Williams ..... E05B 15/04 292/153
5,735,559 A * 4/1998 Frolov ..... E05B 47/0047 292/210
5,850,753 A * 12/1998 Varma ..... E05B 47/0047 292/341.16
5,924,750 A * 7/1999 Fuss ..... E05B 47/0047 292/201
5,988,711 A * 11/1999 Toma ..... E05B 47/0047 292/201
6,076,870 A 6/2000 Frolov
6,454,324 B1 * 9/2002 Lewis ..... E05B 47/00 292/341.16
6,869,114 B2 * 3/2005 Ueki ..... E05C 19/022 292/341.17
7,201,409 B2 * 4/2007 Adachi ..... E05B 17/0041 292/101
7,562,918 B2 * 7/2009 Toma ..... E05B 47/0047 292/340
8,047,582 B1 * 11/2011 Rodgers ..... E05B 15/022 292/201
8,973,956 B2 * 3/2015 Sambommatsu ..... E05C 19/022 292/341.15
2003/0122387 A1 7/2003 Ward
2015/0284976 A1 * 10/2015 Singh ..... E05B 47/0047 292/341.17

* cited by examiner

230

ELECTRIC STRIKE ASSEMBLY

CROSS-REFERENCE TO RELATED APPLICATION

This application claims priority to International Application No. PCT/CA2013/050591, filed on Jul. 30, 2013, which claims priority to U.S. provisional patent application Ser. No. 61/677,212, filed on Jul. 30, 2012, the disclosures of which are incorporated herein by reference in their entirety.

FIELD OF THE INVENTION

The present disclosure relates to door locking mechanisms, more particularly to electric door locking mechanisms known as electric strikes.

BACKGROUND OF THE INVENTION

Electric rim strikes, also known as electric door openers, electric releases, and electric release strikes, are part of a locking mechanism conventionally used to control access to buildings or areas, for example. An electric strike assembly is typically mounted into a door jam and receives a locking feature, such as a latch bolt and/or a dead bolt, which is part of a locking mechanism typically mounted in a door. The rim strike defines an opening in the frame face contiguous with the opening in the jam face of the doorframe. A pivotal keeper selectively closes the opening in the frame face to prevent or allow release of a door's latch bolt in order to lock the door or allow the door to be opened. The electric rim strike may include an actuation means (e.g., an electrically driven motor or solenoid) that works in conjunction with a blocking element, for example, to selectively prevent or allow the rotatable keeper to pivot from a first position, in which the blocking element prevents rotation of the keeper, to a second position, in which the blocking element allows the rotation of the keeper, and vice versa. Rotation of the keeper uncovers or opens the frame face opening, which allows the bolt to freely move through the opening, and thereby allows the door to be opened.

The configuration of conventional electric rim strikes, including the electronics and gear motors, for example, consume a certain amount of power. Moreover, during a continuous duty application, wherein the motor is continuously drawing power to maintain the strike in a particular actuation state, the power consumption may spike and the components of the strike can become hot to the touch, rising as much as 30-40° Fahrenheit. There is a need and desire for an electric rim strike assembly having a configuration designed for low power consumption, which may have the added benefit of reduced temperature rise during continuous duty operation.

SUMMARY OF THE INVENTION

Embodiments of the present disclosure advantageously provide an electric strike assembly and methods of use thereof. In accordance with aspects of the present disclosure, an electric strike assembly includes a housing formed with a recessed portion therein, a keeper pivotally arranged in the recessed portion of the housing, the keeper having an abutment, an actuator assembly having an actuator and an actuator paddle, and a blocking element rotatably mounted in the recessed portion of the housing, wherein cooperation of the actuator paddle with the blocking element is controlled by rotation of the actuator and determines a locking condition of the keeper based on a rotational position of the blocking element with respect to the abutment.

In accordance with other aspects of the present disclosure, a locking system includes a door assembly having a latch, a door frame for mounting the door assembly, and an electric strike assembly mounted in the door frame and configured to receive the latch, the strike assembly having a housing formed with a recessed portion therein, a keeper pivotally arranged in the recessed portion of the housing, the keeper having an abutment, an actuator assembly having an actuator and an actuator paddle, and a blocking element rotatably mounted in the recessed portion of the housing, wherein cooperation of the actuator paddle with the blocking element is controlled by rotation of the actuator, a locking condition of the keeper being determined based on a rotational position of the blocking element with respect to the abutment.

In accordance with yet other aspects of the present disclosure, a method for controlling access through a door includes providing an electric strike assembly having a housing, a keeper pivotally mounted to the housing, the keeper having an abutment, a blocking element rotatably mounted in the housing, and an actuator having an actuator paddle, and actuating the actuator paddle with the actuator to rotate into engagement with the blocking element, wherein the blocking element disengages from the abutment allowing the keeper to pivot open from a home position.

There has thus been outlined, rather broadly, certain embodiments of the invention in order that the detailed description thereof may be better understood, and in order that the present contribution to the art may be better appreciated. There are, of course, additional embodiments of the invention that will be described below and which will form the subject matter of the claims appended hereto.

In this respect, before explaining at least one embodiment of the disclosure in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

BRIEF DESCRIPTION OF THE DRAWINGS

The accompanying drawings, which are incorporated in and constitute a part of this specification, illustrate various embodiments consistent with the invention, and, together with the description, serve to explain the principles of the invention.

DETAILED DESCRIPTION

Figure 2:
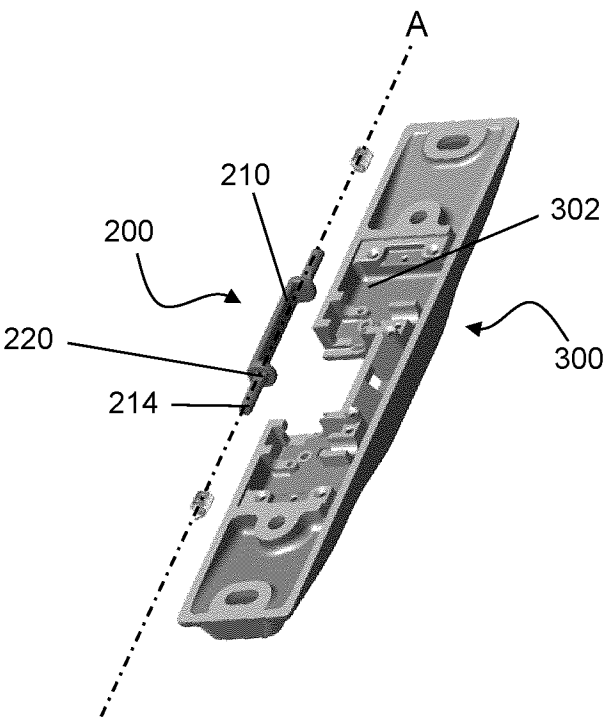
FIG. 2 is a front perspective view of an electric strike assembly with a faceplate removed, in accordance with certain aspects of the present disclosure.

The invention will now be described with reference to the drawing figures, in which like reference numerals refer to like parts throughout.

Various aspects of an electric strike assembly may be illustrated by describing components that are coupled, attached, and/or joined together. As used herein, the terms "coupled", "attached", and/or "joined" are used to indicate either a direct connection between two components or, where appropriate, an indirect connection to one another through intervening or intermediate components. In contrast, when a component is referred to as being "directly coupled", "directly attached", and/or "directly joined" to another component, there are no intervening elements present.

Relative terms such as "lower" or "bottom" and "upper" or "top" may be used herein to describe one element's relationship to another element illustrated in the drawings. It will be understood that relative terms are intended to encompass different orientations of an electric strike assembly in addition to the orientation depicted in the drawings. By way of example, if aspects of an electric strike assembly shown in the drawings are turned over, elements described as being on the "bottom" side of the other elements would then be oriented on the "top" side of the other elements. The term "bottom" can therefore encompass both an orientation of "bottom" and "top" depending on the particular orientation of the apparatus.

Various aspects of an electric strike assembly may be illustrated with reference to one or more exemplary embodiments. As used herein, the term "exemplary" means "serving as an example, instance, or illustration," and should not necessarily be construed as preferred or advantageous over other embodiments of an electric strike assembly disclosed herein.

Figure 1:
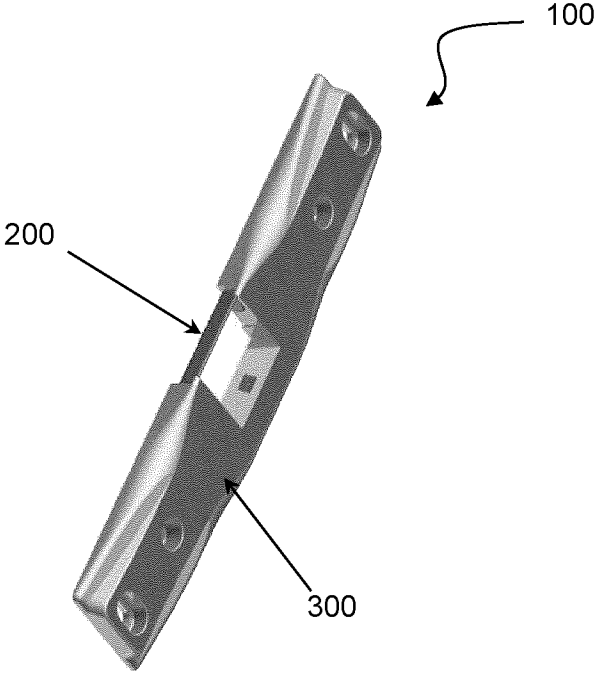
FIG. 1 is a rear perspective view of an electric strike assembly, in accordance with certain aspects of the present disclosure.
Figure 9:
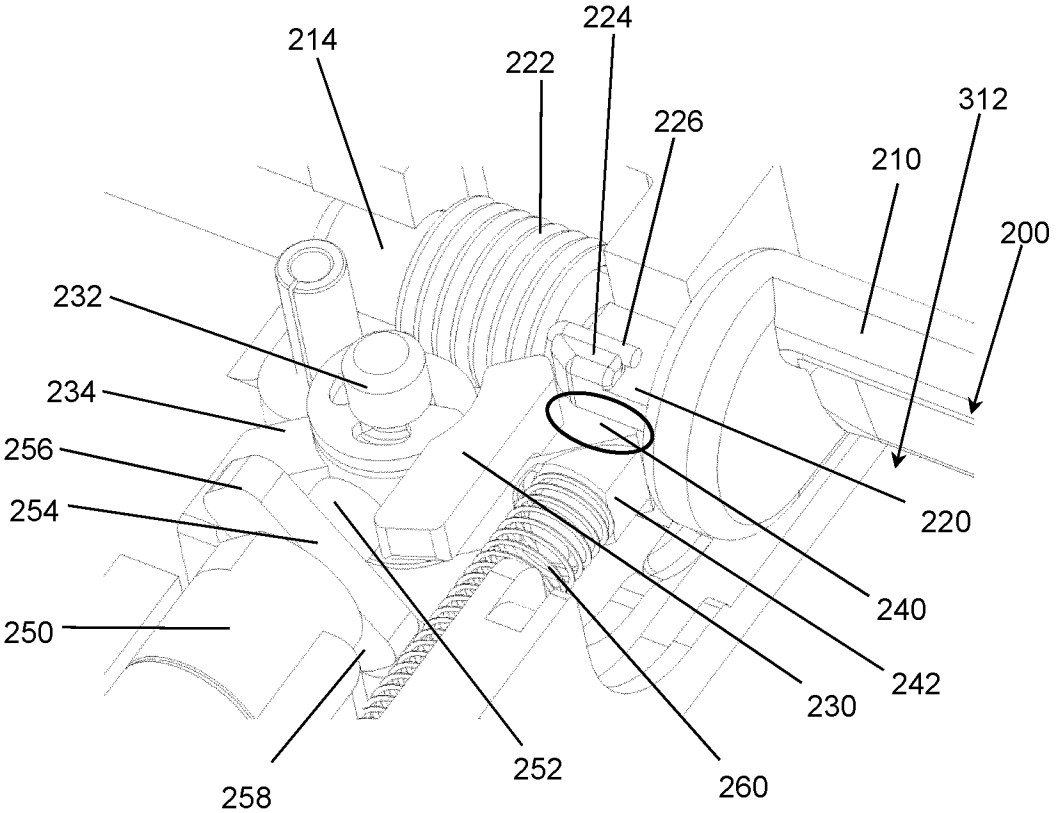
FIG. 9 is an enlarged perspective view of various components of an electric strike assembly, including a blocking element in a certain position of use, in accordance with certain aspects of the present disclosure.

FIG. 1 illustrates an assembled electric rim strike assembly 100 in accordance with aspects of the present disclosure. As shown, the strike assembly 100 includes a keeper 200 pivotably mounted in a housing 300. The keeper 200 may be pivotable between a rotated position (e.g., see FIG. 11), which allows a latch bolt of a door to be removed from the strike to open the door, and a home position (e.g., see FIG. 9) where the keeper 200, if prevented from moving, blocks removal of the latch bolt and thus keeps the door locked. When the keeper 200 is allowed to pivot, the latch bolt can push the keeper aside, so that the door can be opened.

Figure 3:
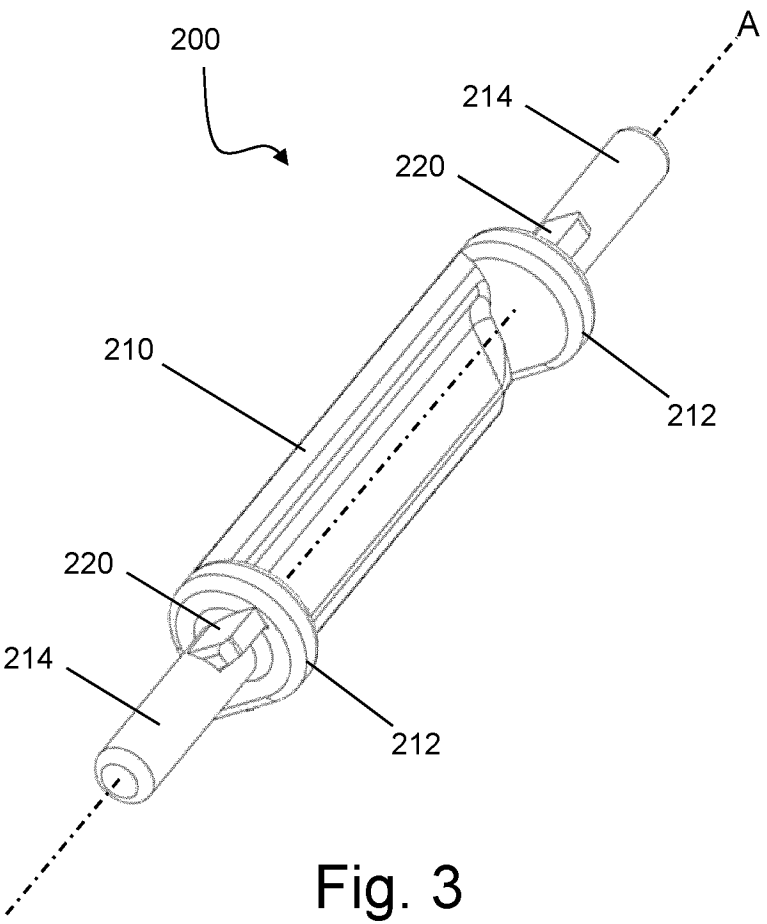
FIG. 3 is a perspective view of a keeper assembly, in accordance with certain aspects of the present disclosure.

As shown in FIG. 2, the keeper 200 may be provided in a recessed portion 302 of the housing 300. As shown more closely in FIG. 3, the keeper 200 may include a keeper bar 210 extending longitudinally between two axle hubs 212. The keeper bar 210 may be mounted between the axle hubs 212 toward one side of the keeper 200 so as to be radially offset from a common axis of rotation A shared by pivot pins 214 extending distally from each axle hub 212. The keeper 200 has at least one and preferably several abutments 220.

Figure 4:
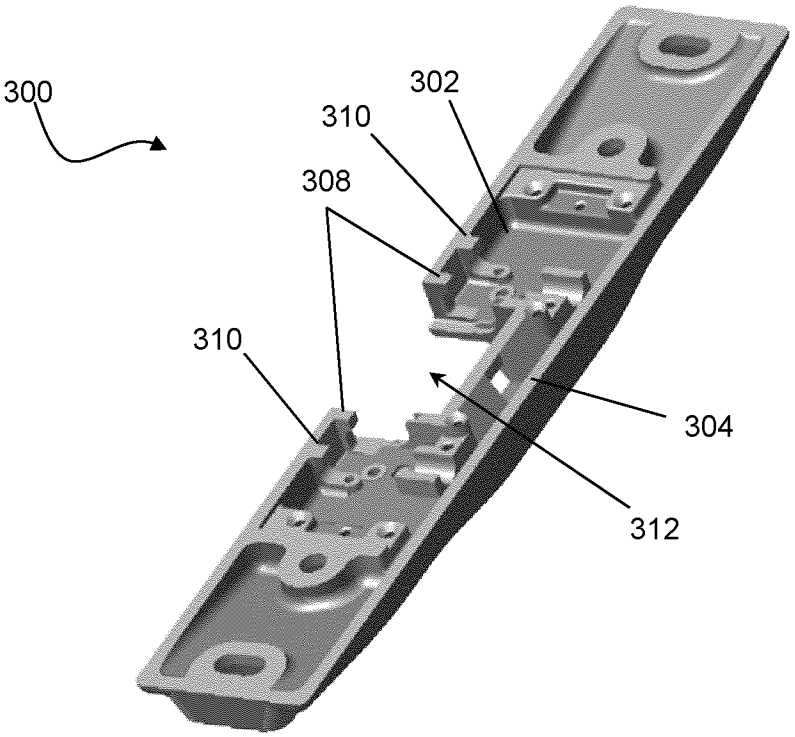
FIG. 4 is a front perspective view of a housing for an electric strike assembly, in accordance with certain aspects of the present disclosure.

As shown more closely in FIG. 4, the housing 300 may be generally rectangular in shape and configured to be substantially closed on one side. A perimeter wall 304 may extend substantially around a periphery of the housing 300 to define the recessed portion 302 therein. Inner and outer keeper mounts, 308 and 310 respectively, may be integrally formed to extend inward from the perimeter wall 304. A latch recess 312 may be provided to extend inward on one side of the housing 300, which in combination with the keeper bar 210 defines a latch cavity 314 for receiving the latch bolt of the door (see FIG. 5).

Figure 5:
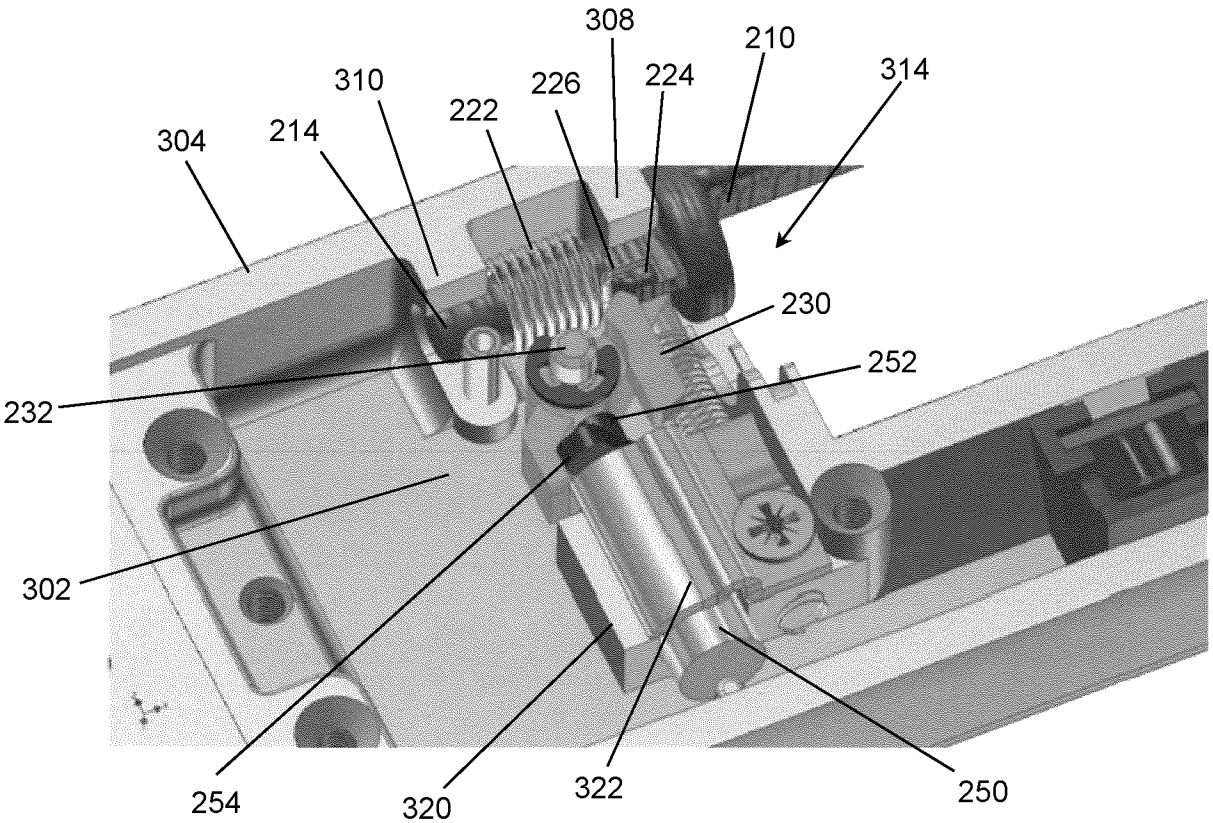
FIG. 5 is an enlarged perspective view of various components of an electric strike assembly, including a locking mechanism, in accordance with certain aspects of the present disclosure.
Figure 6:
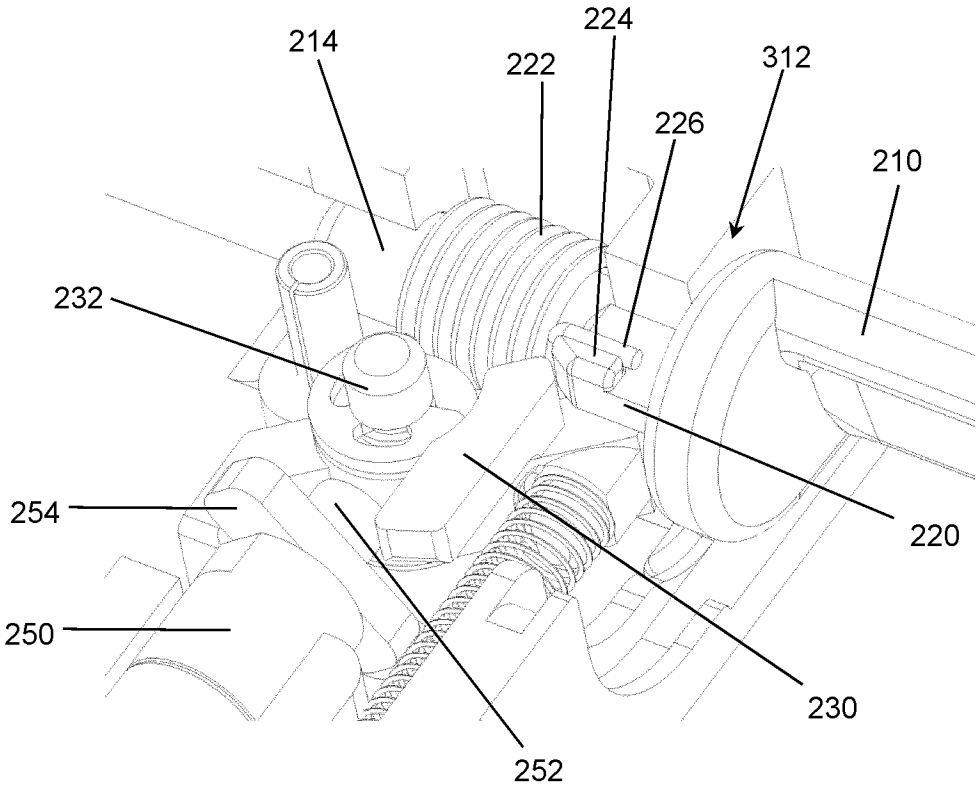
FIG. 6 illustrates an enlarged perspective view of various components of an electric strike assembly, including a locking mechanism, in accordance with certain aspects of the present disclosure.
Figure 7:
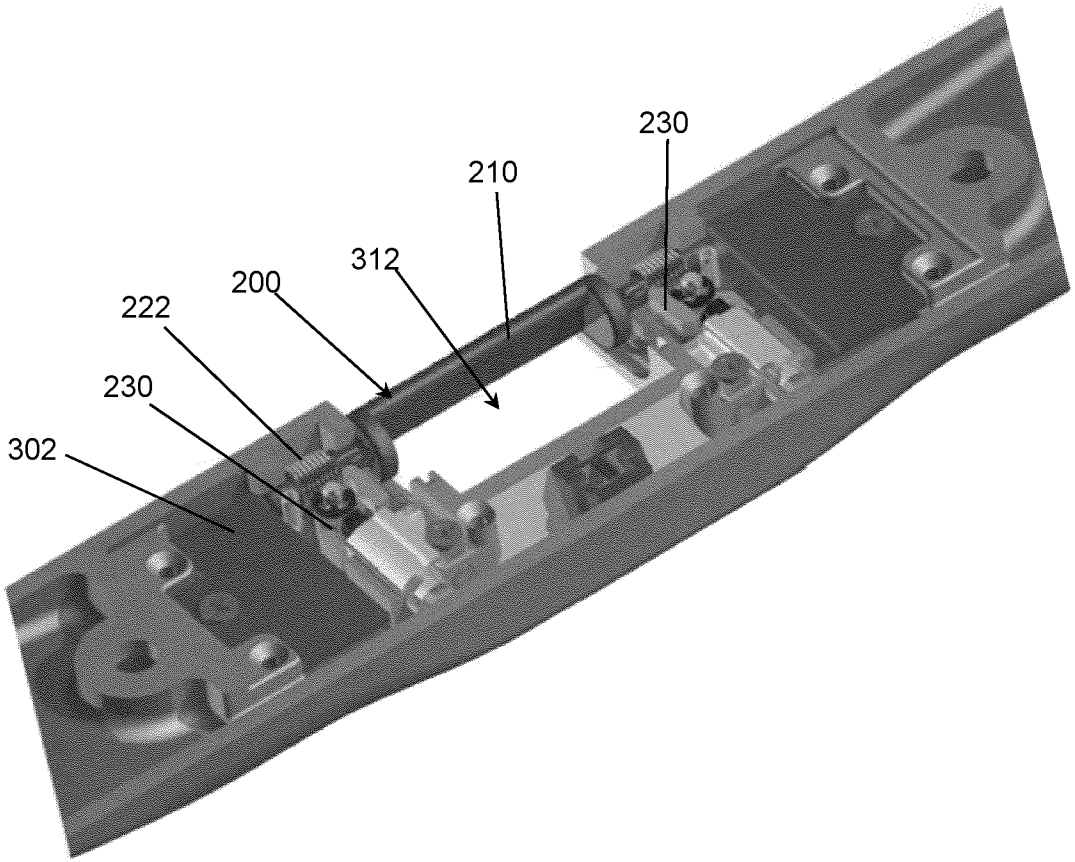
FIG. 7 is a perspective view of a portion of the housing and components of an electric strike assembly, including actuation and locking assemblies, in accordance with certain aspects of the present disclosure.
Figure 28:
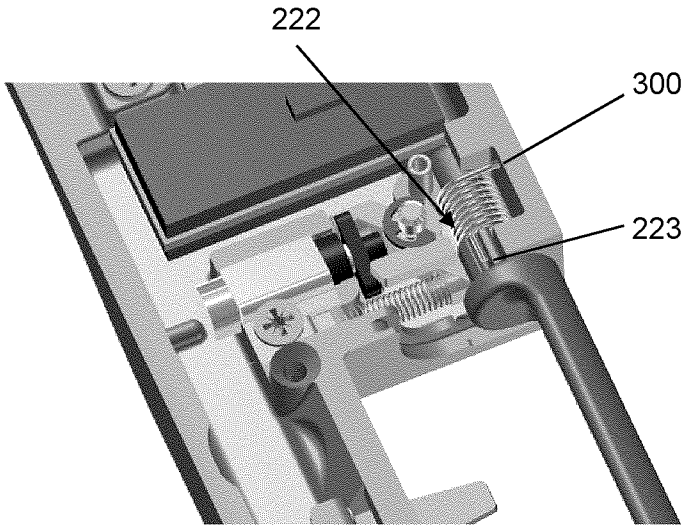
FIG. 28 shows an exploded view of various components of the electric strike assembly to illustrate a mounted keeper spring, in accordance with certain aspects of the present disclosure.
Figure 29:
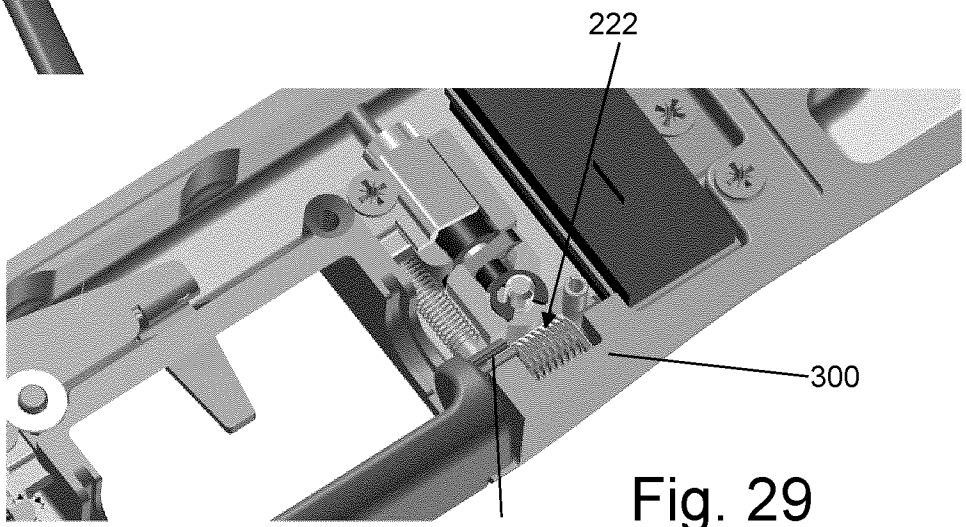
FIG. 29 shows an exploded view of various components of the electric strike assembly to further illustrate the mounted keeper spring shown in FIG. 28, in accordance with certain aspects of the present disclosure.

FIGS. 5-7 are close-up views of aspects of the strike assembly 100 and, in particular, components of the actuation mechanism of the strike assembly 100. Although FIGS. 5 and 6 are provided to illustrate one particular side of the assembly, it may be understood that the same components may be mounted on the other side of the strike assembly 100, as shown in FIG. 7. Accordingly, aspects of the present disclosure contemplate the strike assembly 100 having one or more than one actuation mechanism for controlling the pivoting of the keeper 200 of the strike assembly 100. The pivot pins 214 may be rotatably mounted onto bearing surfaces of the inner and outer keeper mounts 308 and 310 respectively so that the keeper bar 210 extends across the mouth of the latch recess 312 with the keeper bar 210 offset from the axis A on a side toward the outer periphery of the housing 300. A keeper spring 222 may be concentrically mounted on the pivot pin 214, for example, to bias the keeper bar 210 toward a position that maintains the keeper 200 in the home position. For example, a spring catch 224 may be provided on the abutment 220 for seating a first end 226 of the keeper spring 222. In this manner, a spring force is generated upon rotation of the keeper bar 210 so that the keeper bar 210 will return to the home position unless prevented from doing so as explained below. In accordance with yet other aspects of the present disclosure, as shown in FIGS. 28 and 29, the keeper spring 222 may be formed to be mounted at one end against a portion of the housing 300 and at the other end in a spring mount extension 223 of the keeper, depending on the configuration of the spring and which direction of rotation is intended to generate spring force in the opposite rotational direction.

A blocking element 230 may be rotatably mounted into the recessed portion 302 of the housing 300. In accordance with one aspect of the present disclosure, a dowel pin 232 may be provided to serve as a pivot axis for the rotatable blocking element 230. An actuator 250, which may be a micro gearmotor, for example, may be mounted via a motor mount 320, which may be integrally formed with the housing 300. A mounting bracket 322 may be used to hold the actuator 250 in position. The actuator 250 may provide high-speed, high-power rotation to an actuator shaft 252 on which an actuator paddle 254 may be provided. The actuator paddle 254 may be mounted on or integrally formed with the actuator shaft 252 to have a first end portion 256 and a second end portion 258 of the paddle 254 extend linearly from opposing sides of a central axis of the actuator shaft 252 (see FIG. 9).

Figure 8:
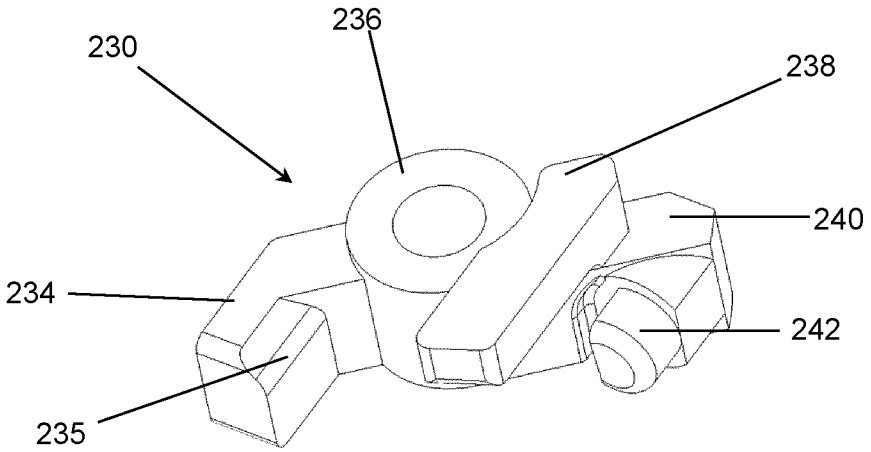
FIG. 8 is an enlarged perspective view of a blocking element for an electric strike assembly, in accordance with certain aspects of the present disclosure.

As shown in enlarged view in FIG. 8, the blocking element 230 may include a paddle arm 234, a mounting hub 236, a stop arm 238, a blocking arm 240, and a return spring mount 242. As shown up close in FIG. 9, the blocking element 230 may be rotatably mounted in the housing 300 so that, in the home position, a portion of the blocking arm 240 is rotated up and under the abutment 220 on the keeper 200 (see circled region). A return spring 260 may be compression mounted between a portion of the housing 300 and the return spring mount 242 of the blocking element 230 so that the blocking arm 240 of the blocking element 230 is rotatably biased toward the keeper 200. Thus, in the home position, the blocking arm 240 of the blocking element 230 is essentially wedged under the abutment 220 of the keeper 200 and maintained in that position by the force exerted by the return spring 260 preventing rotation of the keeper 200. With the blocking element 230 in the position shown in FIG. 9, the actuator paddle 254 of the actuator 250 is in a position with the first portion 256 ready to engage the paddle arm 234. The paddle arm 234 may be formed with a beveled surface 235, for example, to receive the first end portion 256 of the paddle 254.

Figure 10:
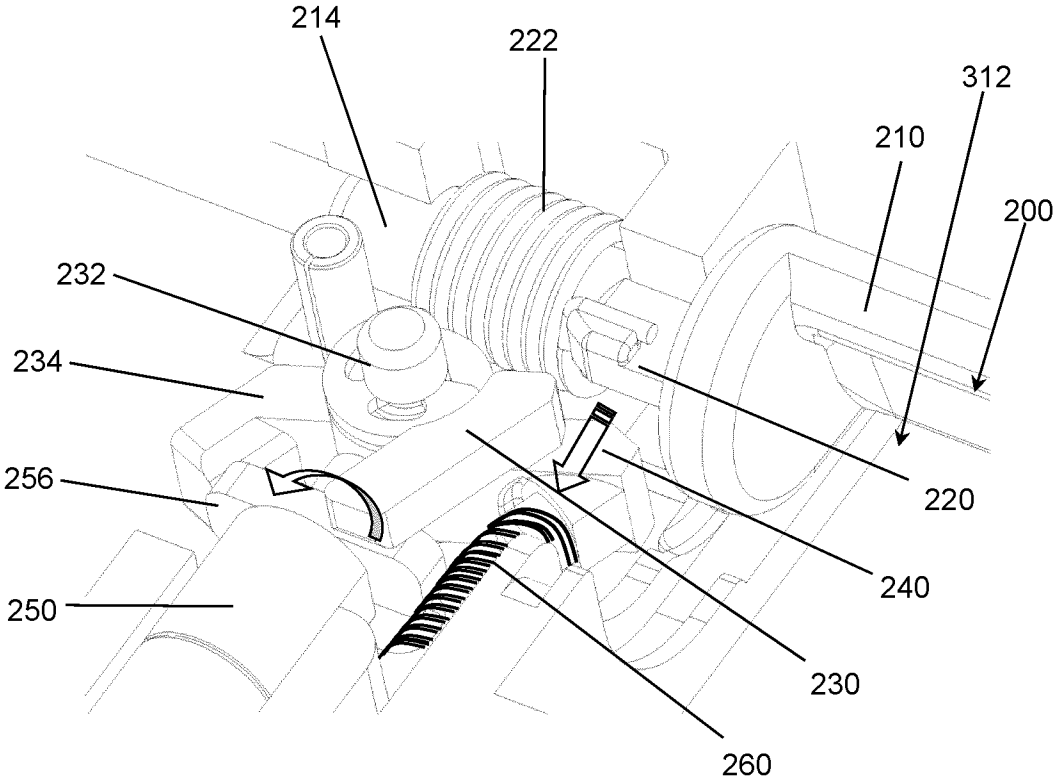
FIG. 10 is an enlarged perspective view of various components of an electric strike assembly, including a blocking element in a certain position of use, in accordance with certain aspects of the present disclosure.
Figure 11:
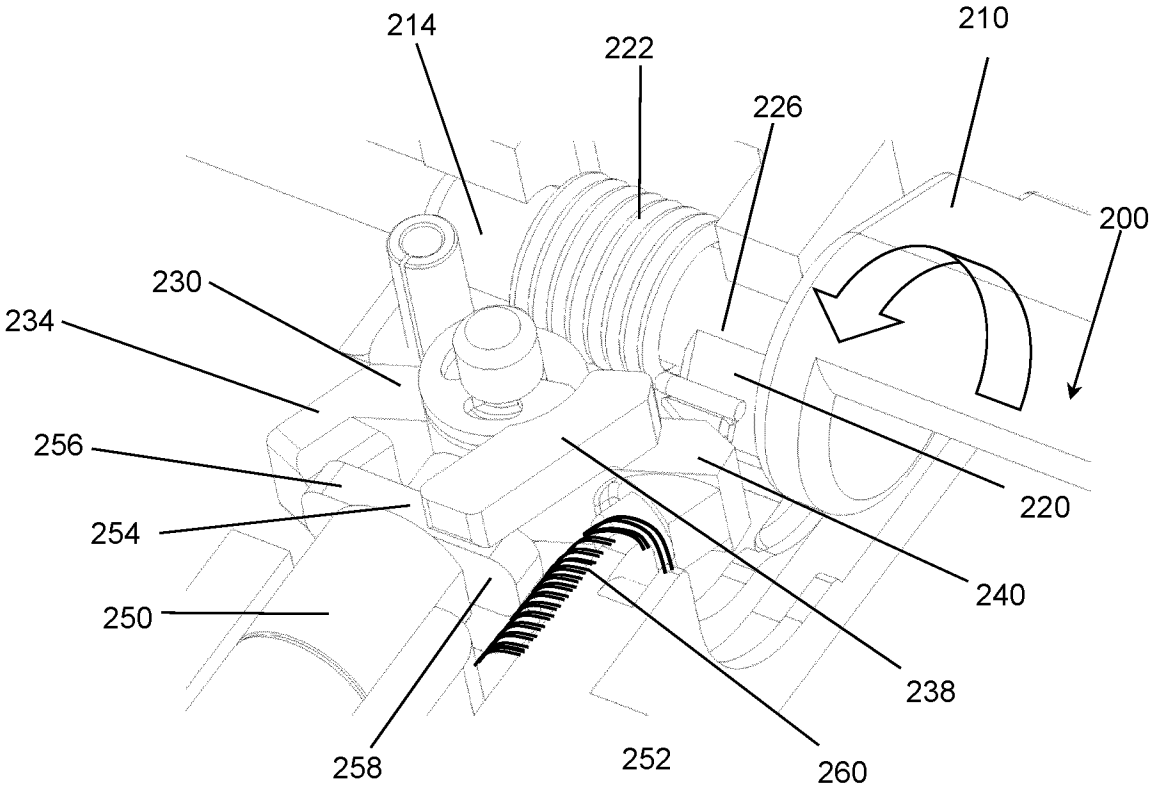
FIG. 11 is an enlarged perspective view of various components of an electric strike assembly, including a keeper assembly in a certain position of use, in accordance with certain aspects of the present disclosure.

As illustrated in FIG. 10, the blocking element 230 may move from the locked home position to an unlocked position and vice-versa via rotation of the paddle 254. The paddle 254 may be rotated by the actuator 250, counterclockwise for example, so that the first end portion 256 engages the beveled surface 235 of the paddle arm 234. Continued rotation of the paddle 254 exerts a rotational force on the blocking element 230 until the force of the actuator 250 overcomes the return force of the return spring 260, the blocking element 230 rotates, and the blocking arm 240 is released from under the abutment 220 of the keeper 200. As shown in FIG. 11, the keeper arm 210 is thus free to pivot about the pivot pins 214 as the abutments 220 are no longer opposed by any portion of the blocking element 230.

Figure 12:
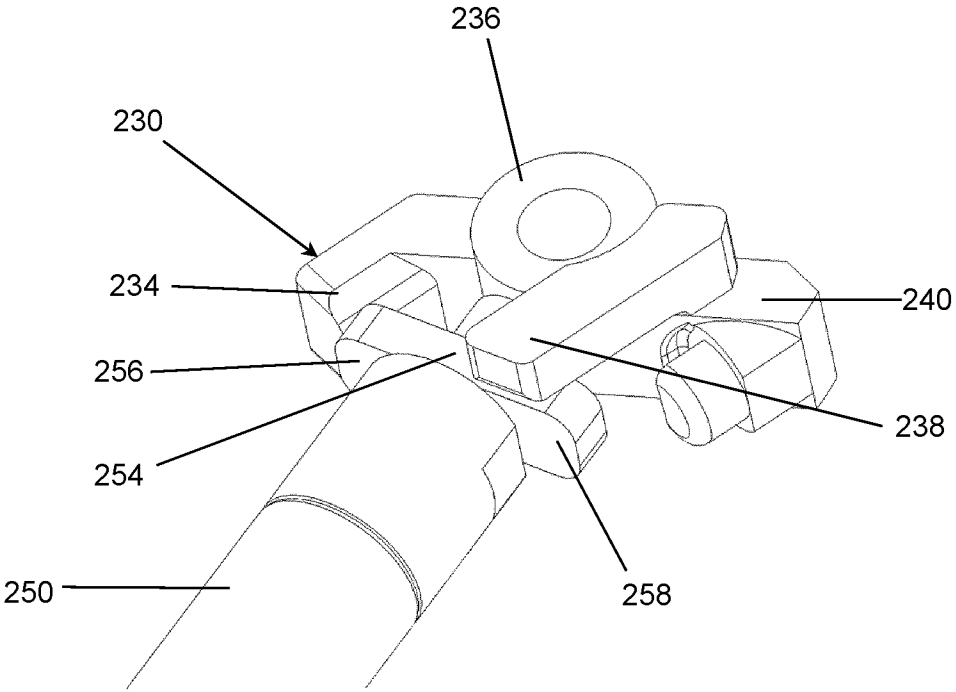
FIG. 12 is an enlarged perspective view of various components of an electric strike assembly, including a blocking element and an actuator paddle in a certain position of use, in accordance with certain aspects of the present disclosure.

As illustrated in FIGS. 11 and 12, rotation of the blocking element 230 also causes the stop arm 238 to rotate over the second end portion 258 of the paddle 254. The rotation of the paddle 254 by the actuator 250 is thus controlled. The paddle 254 may only rotate until the second end portion 258 abuts a lower control surface of the stop arm 238. In this position, the first end portion 256 of the paddle 254 may be locked against the paddle arm 234 of the blocking element 230. Thus, the keeper 200 may be maintained in the unlocked position until the rotational force on the paddle 254 is released or the actuator 250 forced to rotate in the opposite direction, releasing the paddle 254 from abutment against the paddle arm 234 and allowing the return spring 260 to push the blocking arm 240 back under the abutment 220 (as long as the keeper bar 210 has rotated back to the home position by virtue of the keeper spring 222.)

Figure 13:
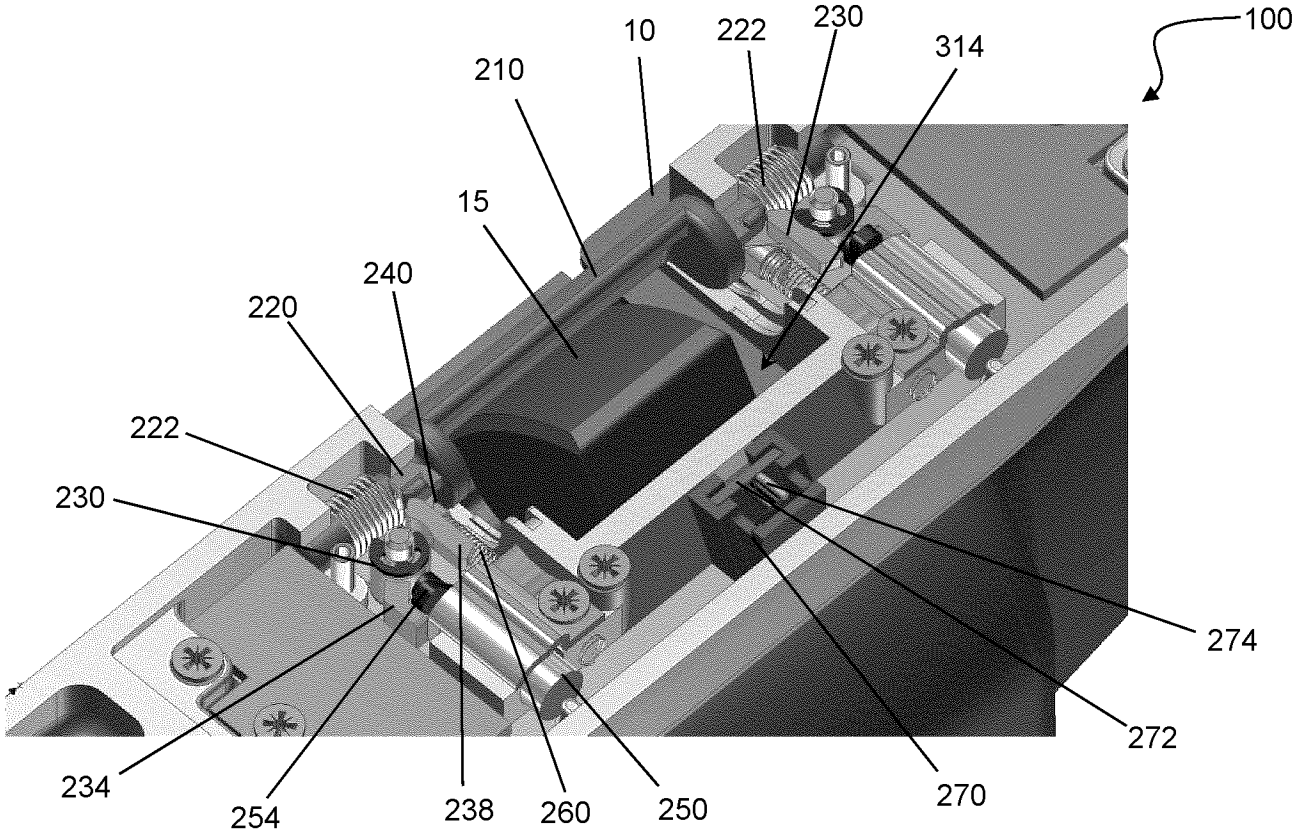
FIG. 13 illustrates the operation of an electric strike assembly, wherein an enlarged view of various components of the electric strike assembly are shown in a certain position of use, in accordance with certain aspects of the present disclosure.

FIGS. 13-17 further illustrate operation of the strike assembly 100. FIG. 13 shows a cutout portion of the strike assembly 100 to illustrate the structural components when in the locked, home position. A latch bolt 15 on a door 10 is shown fully engaged in the latch cavity 314. In the home, locked position, the keeper arm 210 is prevented from rotating due to the blocking element 230 being in a position with the blocking arm 240 wedged under the abutment 220 of the keeper 200. The return spring 260 maintains the blocking element 230 in the locked position. Any attempt to open the door is prevented due to the latch bolt 15 abutting the keeper bar 210 and the keeper bar 210 being unable to rotate into a position to allow the latch bolt 15 to clear the latch cavity 314.

The efficient design of the present disclosure allows for low power consumption, whereby the actuator 150 only draws power (e.g., 50 mA) during rotation of the actuator paddle 254. The strike assembly 100 may be designed to accept a very large input voltage range (4V-30V AC or DC) from a variety of power sources, including direct wiring the assembly 100 into a building's power supply. However, aspects of the present disclosure may also include a battery powered strike assembly, wherein the batteries are contained directly in the strike assembly 100, such as in the recessed portion 302 of the housing 300. In yet other aspects of the present disclosure, power may be provided to the strike assembly via a Power over Ethernet (PoE) connection, in which power may be delivered via an Ethernet connection, simultaneously permitting monitoring, control, and audit capability of the users using or attempting to use the entrance/exit. For example, an embedded door controller 420 (see FIG. 19) may be provided with the strike assembly 100 that is activated by a user via a user interface, such as a Wiegand type interface with a card or access device reader, to permit the door to be opened. The door controller 420 may control the actuator 150 to a certain position, e.g., the home position or a position in which the keeper 200 is free to pivot.

Figure 14:
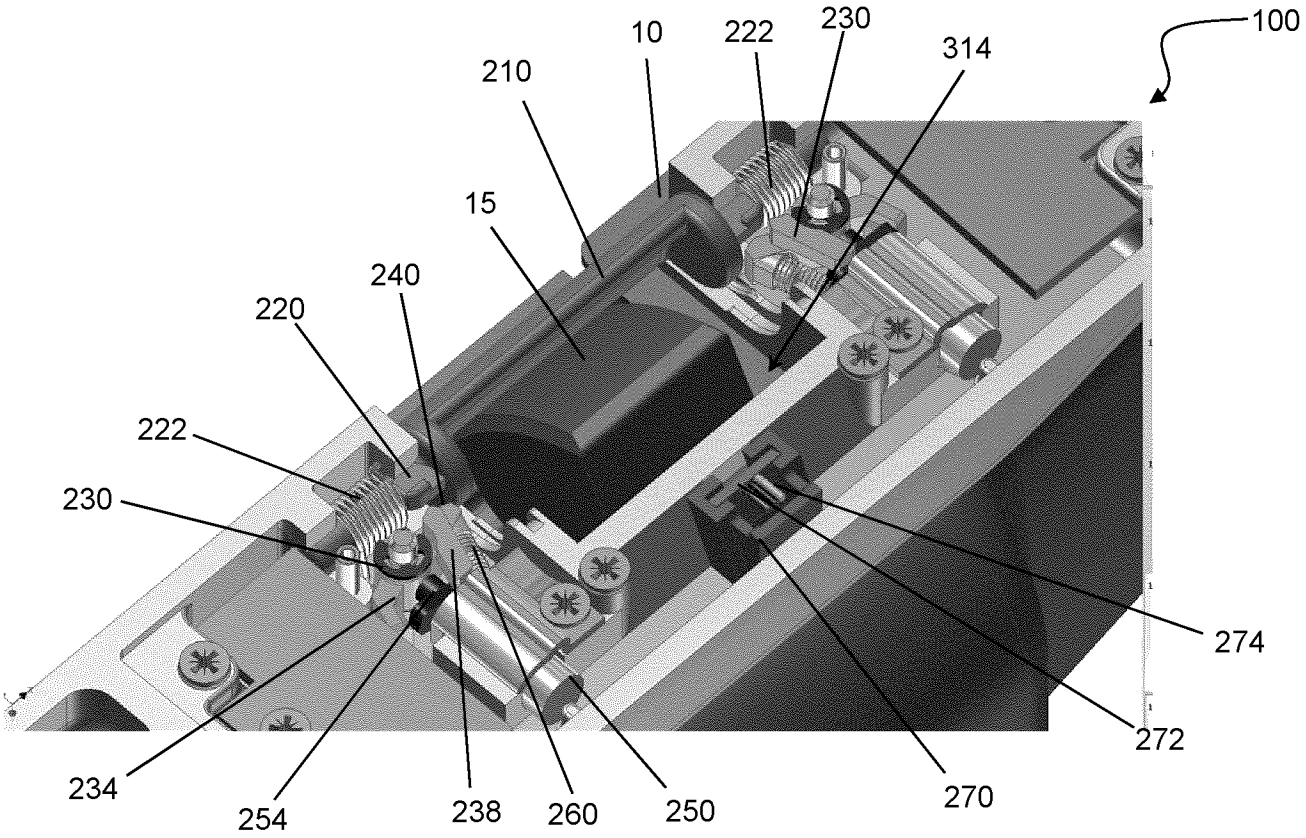
FIG. 14 illustrates the operation of an electric strike assembly, wherein an enlarged view of various components of the electric strike assembly are shown in a certain position of use, in accordance with certain aspects of the present disclosure.
Figure 15:
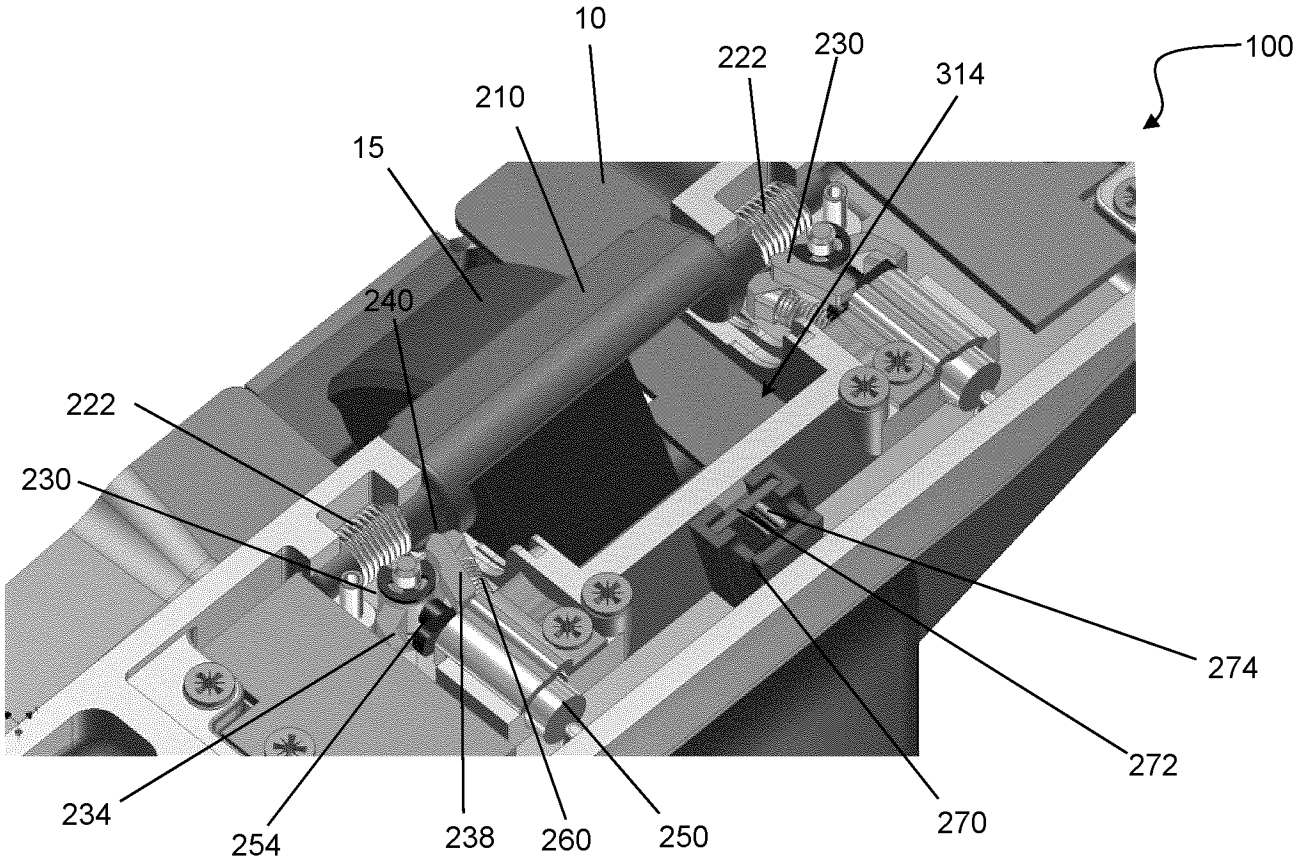
FIG. 15 illustrates the operation of an electric strike assembly, wherein an enlarged view of various components of the electric strike assembly are shown in a certain position of use, in accordance with certain aspects of the present disclosure.
Figure 16:
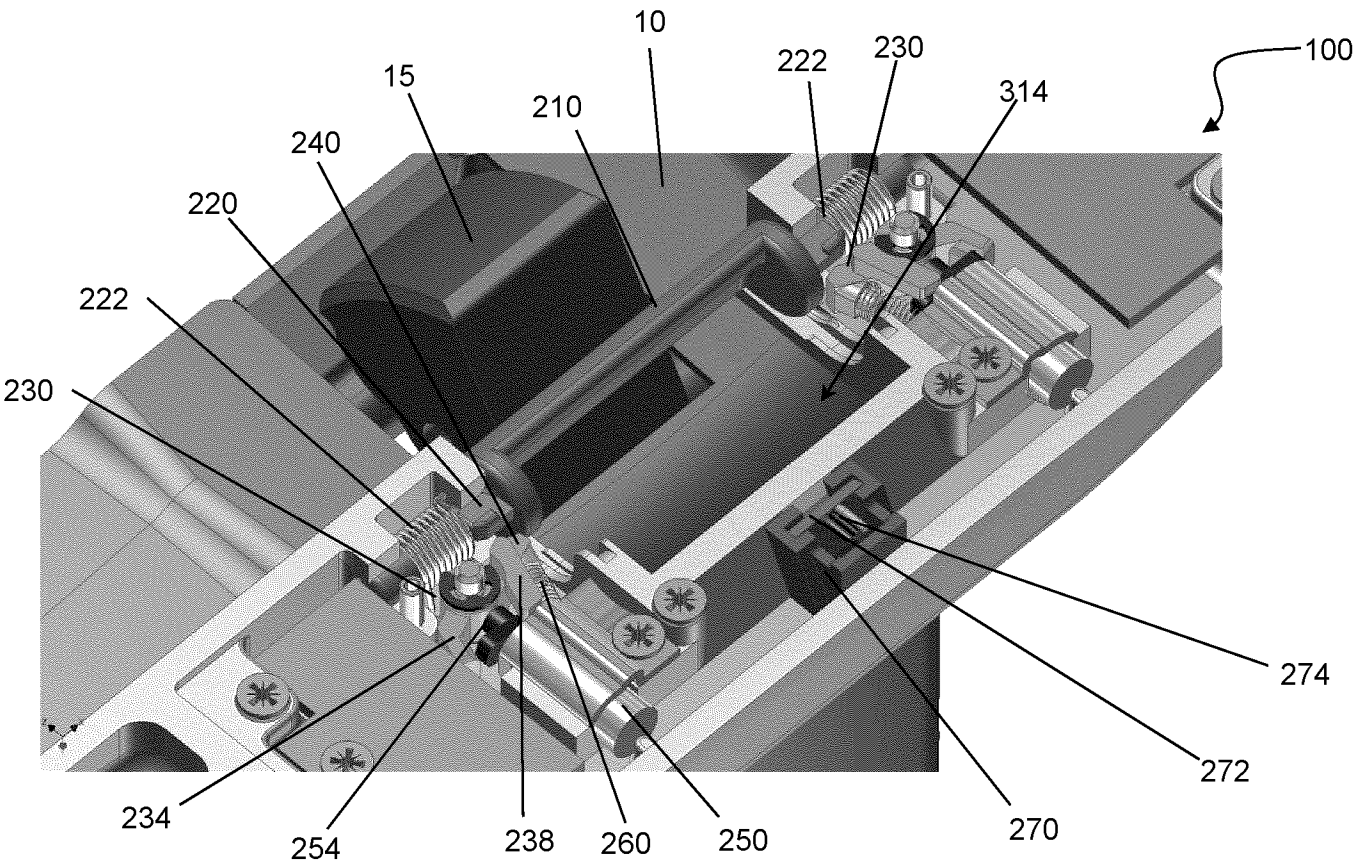
FIG. 16 illustrates the operation of an electric strike assembly, wherein an enlarged view of various components of the electric strike assembly are shown in a certain position of use, in accordance with certain aspects of the present disclosure.
Figure 17:
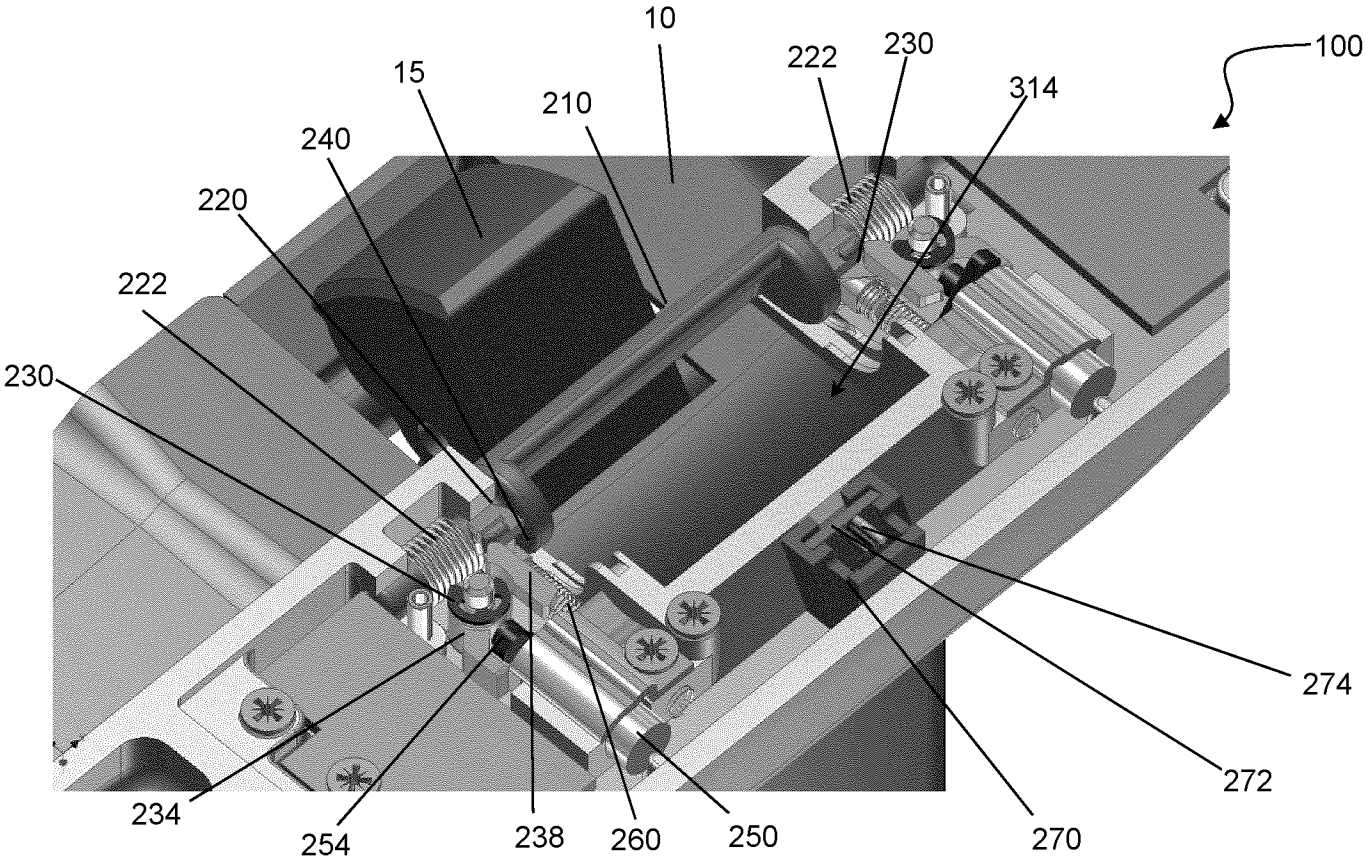
FIG. 17 illustrates the operation of an electric strike assembly, wherein an enlarged view of various components of the electric strike assembly are shown in a certain position of use, in accordance with certain aspects of the present disclosure.

As shown in FIG. 14, for example, once a signal has been sent to the actuator 250, the actuator 250 may force rotation of the actuator paddle 254, which then forces rotation of the abutting paddle arm 234 on the blocking element 230. Rotation of the blocking element 230 releases the blocking arm 240 from under the abutment 220. In this state, the keeper bar 210 is free to rotate as pressure from the latch bolt 15 is applied against the keeper bar 210 by the user opening the door 10. FIG. 15 shows the keeper bar 210 in a rotated position as a result of the latch bolt 15 being freed to exit the latch cavity 314. The pressure applied by the latch bolt 15 against the keeper bar 210 overcomes the holding force of the keeper springs 222 to allow the door 10 to open. FIG. 16 illustrates the latch bolt 15 completely free of the keeper bar 210. Accordingly, the keeper springs 222 bias the keeper back to the closed home position. A timer may be used, for example, wherein the controller automatically controls the actuator 150 to release and/or actuate the blocking elements 230 back into the locked home position after a predetermined amount of time, such as 5 seconds. In this manner, the user who activates the door 10 to the unlocked position may have 5 seconds to open the door before the blocking elements 230 will once again engage the keeper abutments 220 and the door returned to a locked state, as shown in FIG. 17.

As shown in FIGS. 13-17, a removable latch monitoring device 270 may be provided to monitor the position of the latch bolt 15 in the latch cavity 314. The latch monitoring device 270 may be wired into an alarm panel, for example. In accordance with yet another aspect of the present disclosure, if the strike assembly 100 has an embedded door controller, the alarm function provided by the latch monitoring device 270 could be routed through the embedded controller. The latch monitoring device 270 may be a single removable component for easy maintenance, removal, and/or replacement in the field. The monitoring device 270 may be an infrared device for determining the presence and/or location of the latch bolt 15 in the cavity 314. An infrared viewing aperture (not shown) may be provided in a support wall of the housing 300 to permit unobstructed viewing of the latch cavity 314 by the monitoring device 270. The monitoring device 270 may include a printed circuit board 272 and associated wires 274, connected to, for example, a controller, an alarm circuit, a power supply, and/or ground. The latch monitoring device 270 may operate, for example, to identify when the door is closed and the latch bolt 15 of the door 10 is fully extended and retained by the keeper 200 in the cavity 314.

Figure 25:
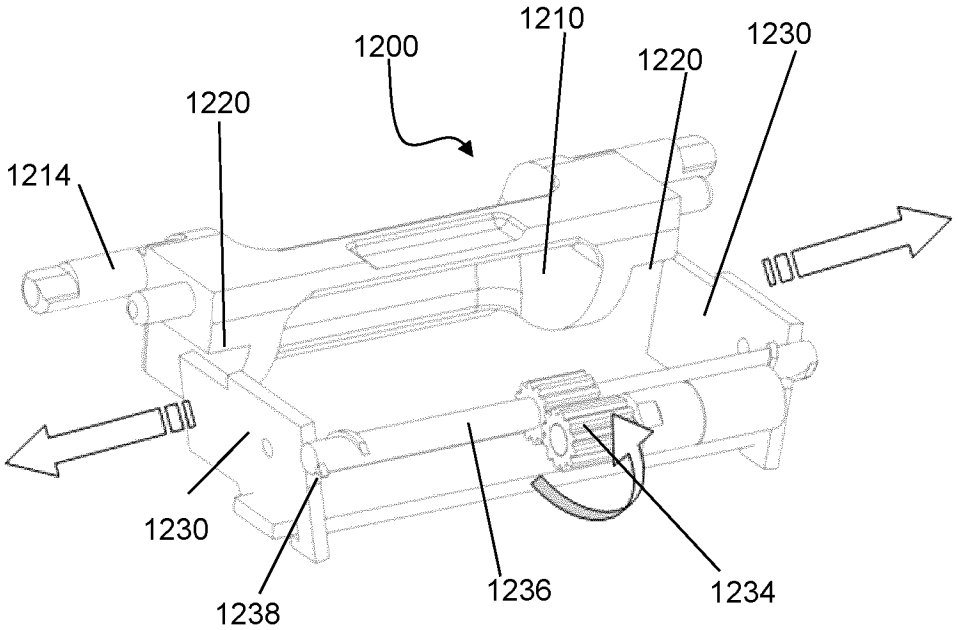
FIG. 25 is a perspective view of another keeper assembly and other various components of an electric strike assembly in a certain position of use, in accordance with certain aspects of the present disclosure.
Figure 26:
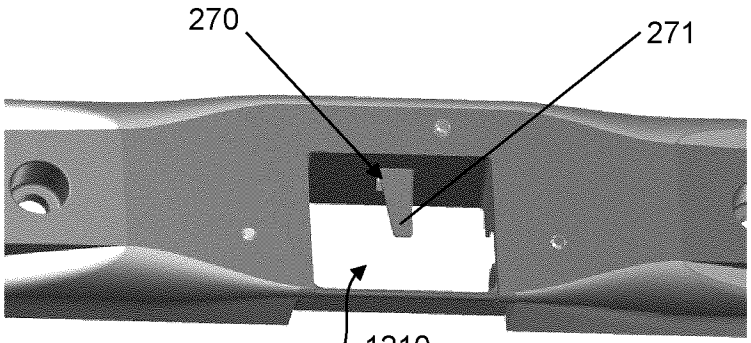
FIG. 26 shows an exploded view of various components of the electric strike assembly to illustrate a latch monitoring device, in accordance with certain aspects of the present disclosure.
Figure 27:
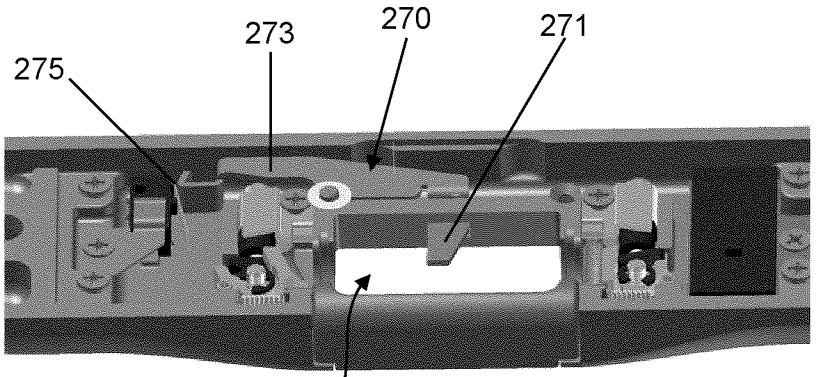
FIG. 27 is another exploded view of various components of the electric strike assembly to further illustrate the latch monitoring device shown in FIG. 26, in accordance with certain aspects of the present disclosure.

In accordance with other aspects of the present disclosure, as shown in FIGS. 25 and 26, the latch monitoring device 270 may include a latch bolt plate 271 that is depressed when the door latch bolt is secured in the cavity 314, causing a cam 273 or similar actuation device to activate a microswitch 275 to send a signal to the remote monitoring device (e.g., alarm system or embedded controller) regarding the status of the door.

In accordance with yet other aspects of the present disclosure, when powered with alternating current (AC), the efficient, quiet nature of the strike assembly 100 may not alert a user to the unlocked/locked state of the door 10 during operation. A sound device or buzzer may be embedded in the strike and optionally connected to the controller, for example, to provide a selectable option of sound generation to indicate when the strike is being powered and the door is in a particular state.

The electric strike assembly may include an option for selectively choosing which state (i.e., locked or unlocked) the strike will remain in a power-off mode. For example, a Failed Lock/Failed Unlock dual in-line package (DIP) switch may be located on the back of the strike assembly and configured to allow the installer to choose which state the strike will remain in most of the time. Equivalently, it allows the installer to choose how the yellow wire (the switching wire) in the electrical circuitry operates. With the switch set to a failed lock position, and with the red and black wires connected to power and ground respectively, the strike will remain locked. Applying power to the yellow (switch) wire, will unlock the strike by actuating the actuator and operating the assembly as described herein, and removing power from the yellow (switch) wire will return the strike assembly to a locked state. In a failed unlock position, with the red and black wires connected to power and ground respectively, the strike will remain unlocked (i.e., a baseline position of the blocking element is disengaged from the abutment of the keeper, allowing the keeper to freely open). Applying power to the yellow (switch) wire, will lock the strike assembly (i.e., the actuator will rotate the blocking element into an engagement position with the abutment of the keeper), and removing power from the yellow (switch) wire the strike will return to an unlocked state.

Figure 18:
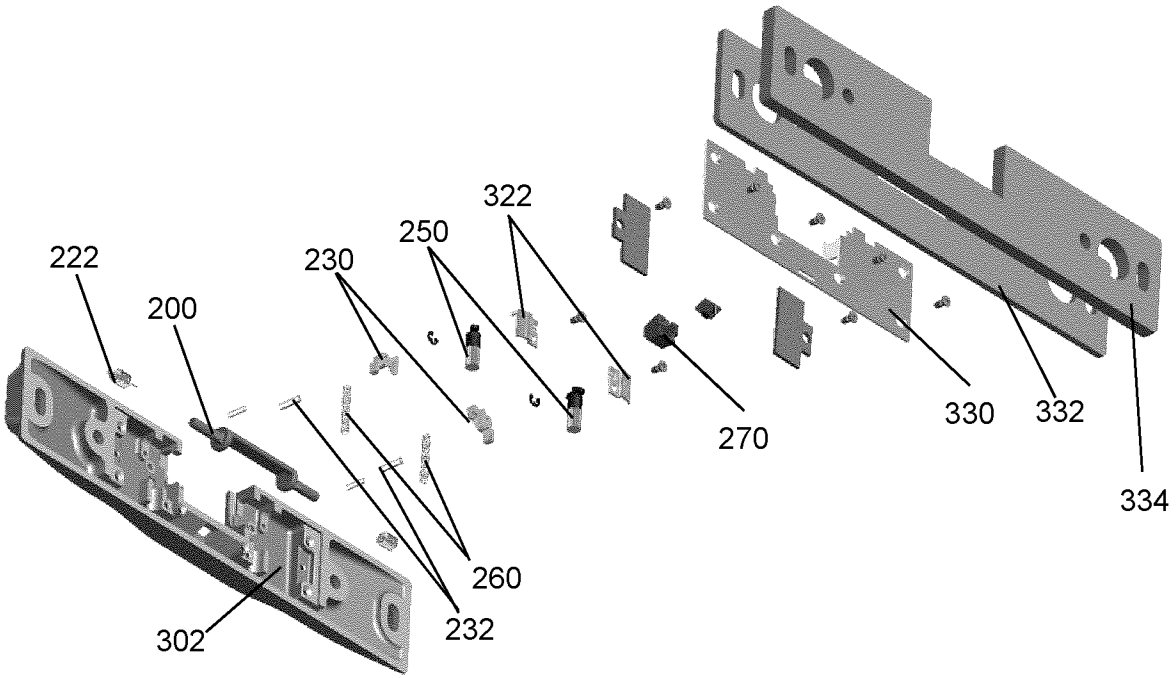
FIG. 18 shows an exploded view of various components of the electric strike assembly, in accordance with certain aspects of the present disclosure.

FIG. 18 provides an exploded view illustration of the various structural components of the electric strike assembly 100. As shown, the assembly 100 includes the keeper 200 rotatably mounted in the housing 300. The components of the locking mechanism may be provided as shown and configured to be mounted into the recessed portion 302 of the housing 300 as explained above. These components include the keeper springs 222, block elements 230, the actuators 250, the return springs 260, and the monitoring device 270. Other mounting hardware, including the dowel pins 232, the mounting brackets 322, and various screws, rivets, dowels, and spacers are shown that are configured to secure the components into the housing 300. A closing plate 330 may be provided to close and protect the recessed portion 302, and an optional spacer plate 332 and/or a face plate 334 may be provided for mounting the assembly 100 to be flush with a door jam.

Figure 19:
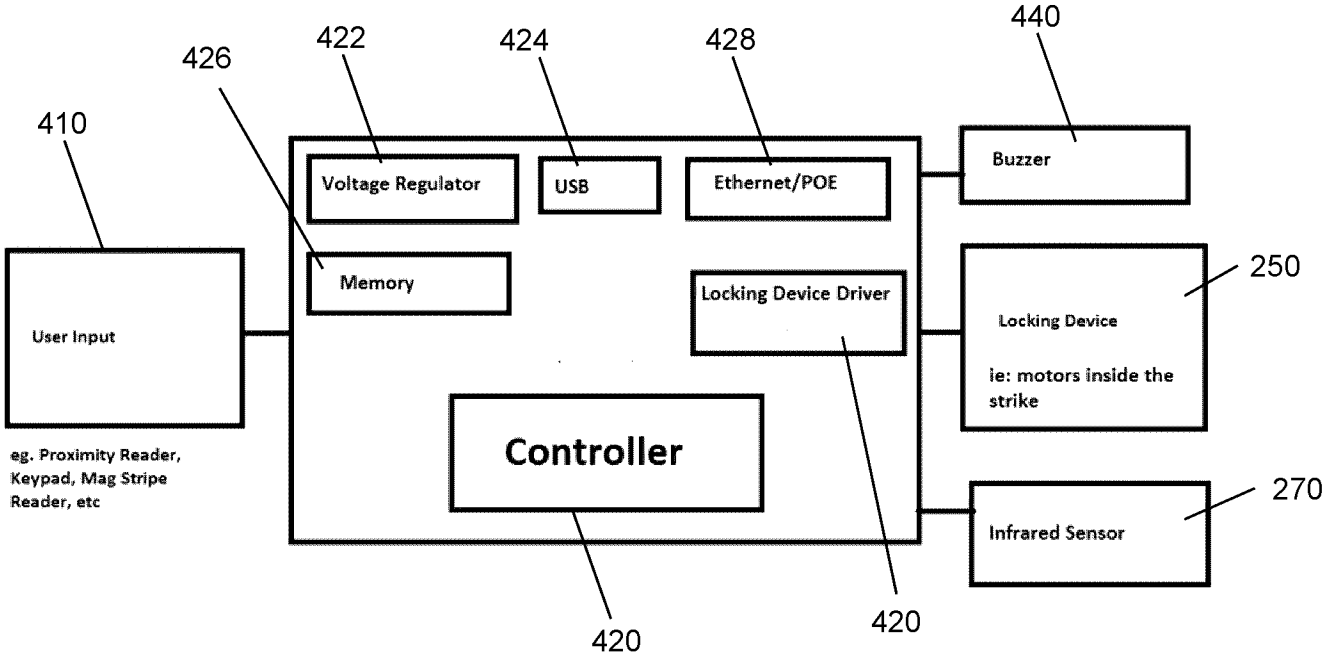
FIG. 19 illustrates a control system for an electric strike assembly, in accordance with certain aspects of the present disclosure.

FIG. 19 illustrates aspects of a control system 400 that may be provided separately or as an embedded feature of the strike assembly 100, as described above. The control system 400 may include a user input 410, such as a WiGand type proximity reader, a keypad, or magnetic stripe reader. The user input 410 may be connected to a controller 420, which may be embedded directly into the strike assembly 100, via a wired connection or any other suitable connection, including a secured wireless connection, for example. The controller 420 may include or be configured to control a voltage regulator 422, a Universal Serial Bus (USB) connection 424, memory 426, an Ethernet connection 428, and a locking device driver 430 for controlling aspects of a sound device 440, the actuator 250 (i.e., locking device) and the monitoring device 270 (i.e, infrared sensor), as described in further detail above. User access settings and other access data may be uploaded to the controller 420 via the Ethernet connection and/or the USB connection, allowing selective configuration of the controller directly and/or remotely in order to control the access parameters of a particular entrance/exit. Based on the access parameters stored in the memory 426, for example, the controller may process the user input to determine whether to deactivate the locking device in order to unlock the strike assembly and permit passage through the door. The controller may be programmed and/or controlled to activate the sound device 440 and/or may receive status information from the monitoring device 270 during or after operation of the strike assembly 100. For example, in the event that the door does not fully close following activation of the strike assembly 100, an alarm signal may be generated and sent via the Ethernet connection, for example, to provide notice as to the condition. Moreover, an audit trail of user access and/or the occurrence of alarm conditions, for example, may be stored and/or provided through the controller 420 and the control system 400.

Figure 20:
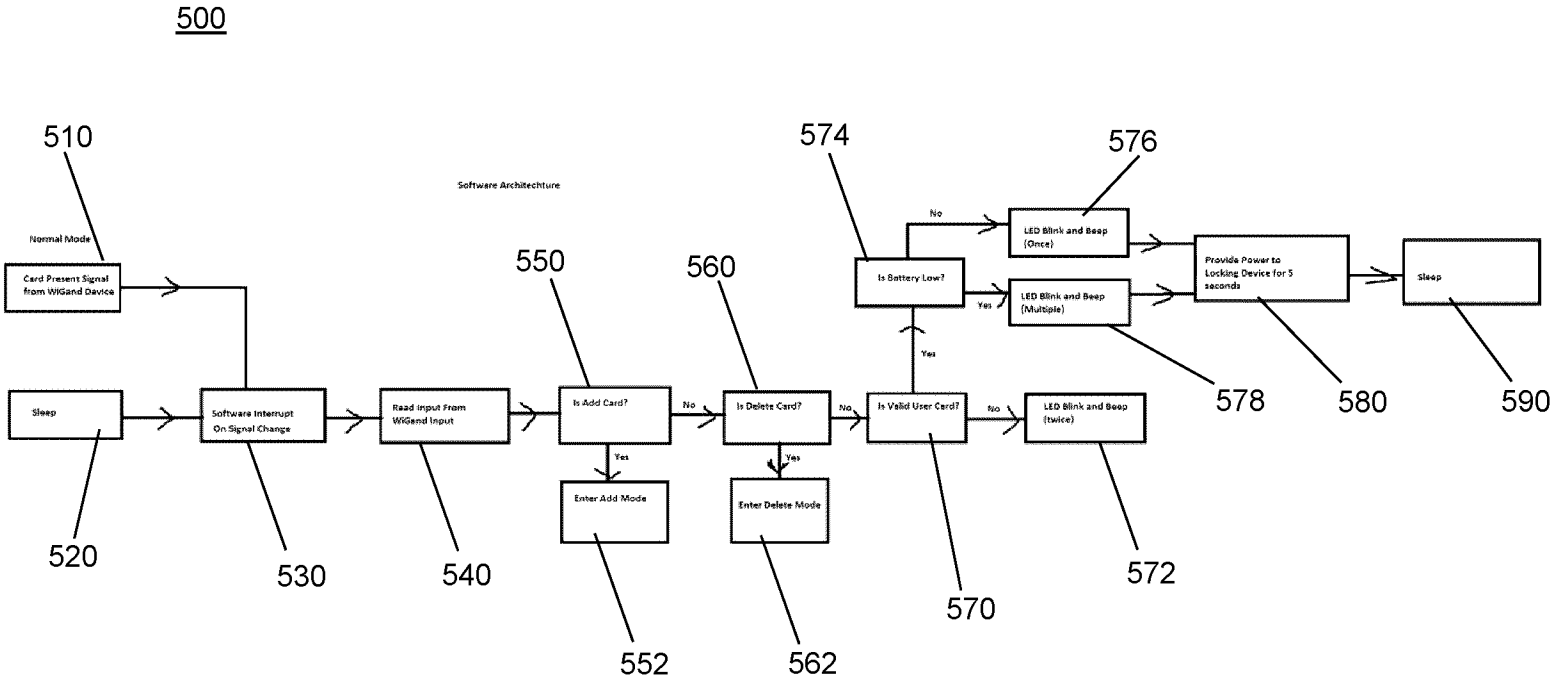
FIG. 20 illustrates the software architectural aspects of a Normal Mode process for the control system of the electric strike assembly, in accordance with certain aspects of the present disclosure.
Figure 21:
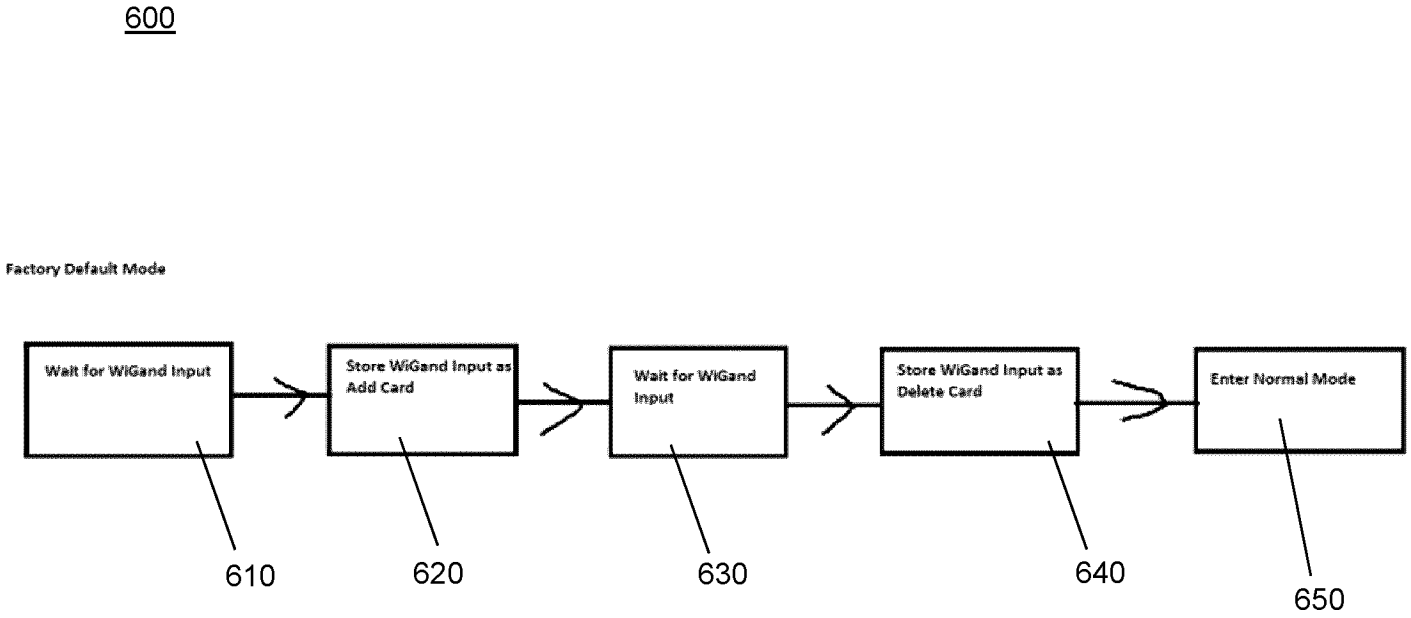
FIG. 21 illustrates the software architectural aspects of a Factory Default Mode process for the control system of the electric strike assembly, in accordance with certain aspects of the present disclosure.
Figure 22:
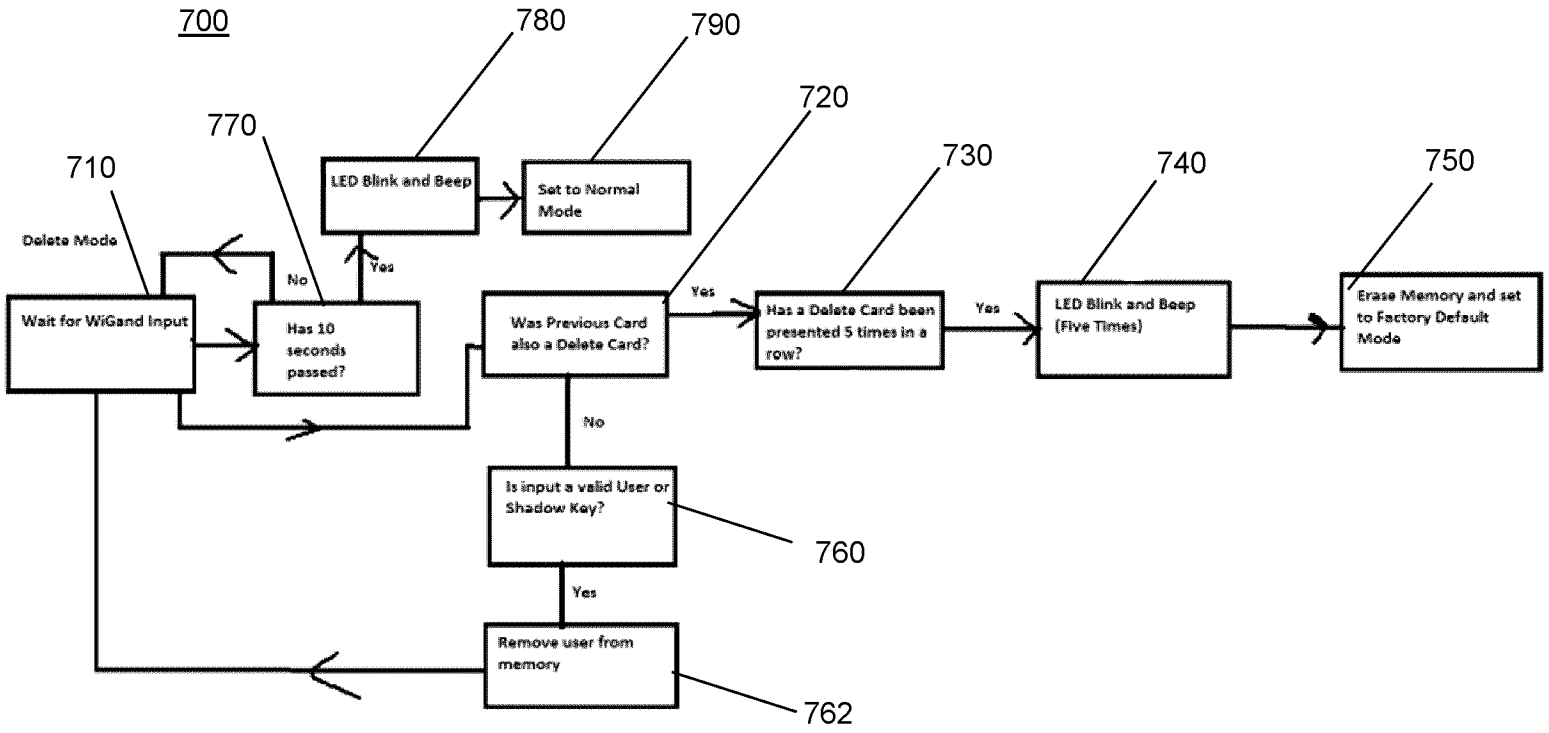
FIG. 22 illustrates the software architectural aspects of a Delete Mode process for the control system of the electric strike assembly, in accordance with certain aspects of the present disclosure.

FIGS. 20 through 22 illustrate various aspects of an exemplary software architecture that may be used with the control system 400. For example, as shown in FIG. 20, a normal access mode process 500 may include a card present signal being generated from the input device 410 (i.e., the WiGand Device) at step 510. Based on the generation of the card present signal, the system may incur a software interrupt at step 530 which may awaken the control system from a sleep mode shown at 520. At step 540, the controller 420 may read the input from the input device 410. If the input indicates at step 550 that the card is, for example, an add card, the software will enter an add mode at step 552 during which user input may be requested and/or specific information stored on a user card may be read to add the user to memory for future access. If the input indicates that the card is not an add card but rather a delete card, at step 560, the system will enter a delete mode 562 during which the user data associated with a particular card may be removed from memory. At step 570, if the input indicates that the card is neither an add card or a delete card, the system will check if the input indicates a valid user. If not a valid user, the system will send a signal at step 572, such as a patterned LED blink and/or sound beep, indicating the user is not permitted access. If the input indicates that the card is a valid user, a battery check for the input device may be provided at step 574 to check whether the battery, for example, is low. Depending on whether the battery is indicated as low, a specific patterned LED signal and/or sound beep, for example, may be provided at steps 576 and 578. Because the card indicated a valid user, at step 580 the actuator 250 in the strike assembly 100 may be controlled via the controller 420 to rotate the paddle 254 and unlock the keeper 200 for a predetermined period of time (e.g., 5 seconds) to permit passage of the user through the door. Following the predetermined period of time, at step 590, the control system 400 enters a sleep mode until interrupted by the next card control signal.

FIG. 21 illustrates a Factory Default Mode process 600 during which the control system 400 may wait for input from the input device at step 610 (i.e., the WiGand input). At step 620, an initial card input may be stored as an add card in order to establish an add card function. At step 630, the system returns to a wait mode until receiving an input at step 640 to be stored as a delete card. At step 650, the system may then enter the normal mode process 500 described above.

FIG. 22 illustrates an exemplary Delete Mode process 700. Once the control system 400 enters the delete mode, the system 400 waits at step 710 for additional input from the user. For example, at step 720, if the previous card input indicated a delete card, the system may check at step 730 if a delete card has been presented a certain number of times, such as five. If a delete card has been presented five times, the control system 400 recognizes that the system is to be reset. A preset signal will be provided at step 740, such as blinking the LED and providing sound beeps in a series of five. At step 750, the system controller 420 will then erase the memory 426 and set the system to the Factory Default Mode. However, with respect to simply deleting one user, for example, if at step 720 the previous card was a delete card, but a delete card had not been presented more than once, at step 760 a valid user card may be presented. If a valid user card is presented at step 760 following the presentation of a delete card to initiate the delete mode process 700, the user data associated with the valid user card will be removed from the memory 426 at step 762. However, if at 710, no additional input is received following presentation of a delete card, for example, following a period of ten (10) seconds 770, a signal may be sent at step 780 indicating as such and the system 400 set back to the Normal Mode at step 790. An Add User process is substantially the same as the Delete Mode process with the exception that an add user card is used to initiate the process and the valid user's information is added to memory rather than erased from memory.

The advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

Figure 23:
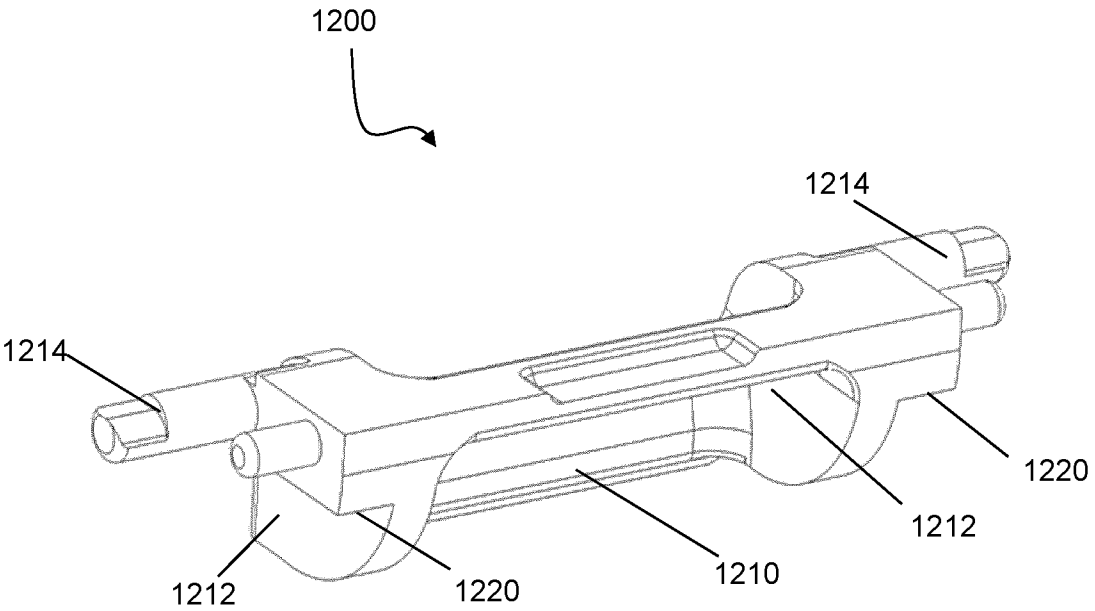
FIG. 23 is a perspective view of another keeper assembly, in accordance with certain aspects of the present disclosure.

For example, FIG. 23 illustrates aspects of another keeper 1200 for use in a strike assembly 1000. As with the keeper 200 described above, the keeper 1200 may be provided in the recessed portion 302 of the housing 300 and include a keeper bar 1210 extending longitudinally between two axle hubs 1212. Pivot pins 1214 may extend distally from each axle hub 1212 and the keeper 1200 may have one or more keeper abutments 1220.

Figure 24:
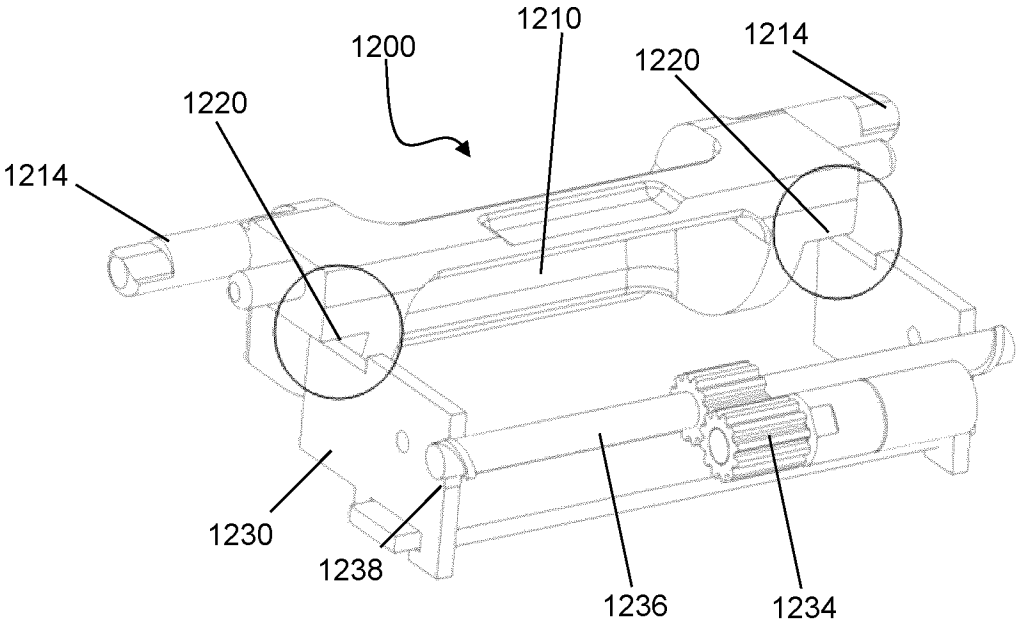
FIG. 24 is a perspective view of another keeper assembly and other various components of an electric strike assembly, in accordance with certain aspects of the present disclosure.

As shown in FIGS. 24 and 25, the blocking elements 1230 may be plates configured to slide under the abutments 1220. The actuator 1250 may be mounted to drive a gear assembly 1234 that converts the torsion generated through the actuator into rotation of a drive axle 1236. The drive axle 1236 may be reverse threaded at each end, for example, having a right hand external thread provided toward a right end and a left hand external thread provided toward the left end. The blocking elements 1230 may have axle engaging portions 1238 for engaging the threaded end portions of the drive axle 1236. The axle engaging portions 1238 may be configured to translate rotational actuation of the drive axle 1236 into translational motion of the blocking elements 1230. Accordingly, as shown in FIG. 25, rotation of the drive axle 1236 driven by the actuator 1250 and gear assembly 1234 forces the blocking elements 1230 to translate away and out from under the keeper abutments 1220. As described with respect to the keeper 200 above, the keeper 1200 is now free to pivot about the pivot pins 1214 to release the latch bolt.

What is claimed is:

1. An electric strike assembly, comprising:

a housing formed with a recessed portion therein;

a keeper pivotally arranged in the recessed portion of the housing, the keeper having an abutment, the keeper including a keeper bar extending longitudinally between two axle hubs, and the keeper including two pivot pins with one pivot pin extending distally from each of the two axle hubs and defining an axis of rotation;

an actuator assembly having an actuator and an actuator paddle;

a blocking element rotatably mounted in the recessed portion of the housing, the blocking element including a paddle arm extending from a mounting hub with the actuator paddle cooperating with the paddle arm to rotate the blocking element about the mounting hub, and the blocking element including a blocking arm configured to wedge below the abutment on the keeper when the keeper is in the home position, wherein cooperation of the actuator paddle with the blocking element is controlled by rotation of the actuator, a locking condition of the keeper being determined based on a rotational position of the blocking element with respect to the abutment; and a return spring, wherein the blocking arm includes a return spring mount for compression mounting the return spring between a portion of the housing and the return spring mount, and the return spring rotatably biasing the blocking element toward the keeper.

2. The electric strike assembly of claim 1, wherein the keeper bar is radially offset from the axis of rotation on a side toward a periphery of the housing.

3. The electric strike assembly of claim 1, further comprising a latch recess extending into the housing on a longitudinal side of the assembly, wherein a keeper spring is concentrically mounted on one of the pivot pins to bias the keeper bar toward a home position extending across a mouth of the latch recess.

4. The electric strike assembly of claim 1, wherein to release the keeper from the home position, rotation of the actuator paddle against the paddle arm exerts a rotational force on the blocking element to overcome a holding force of the return spring, the blocking element thus rotating to disengage the blocking arm from the abutment.

5. The electric strike assembly of claim 4, wherein the blocking element further comprises a stop arm, the stop arm configured to rotate over a portion of the actuator paddle when the blocking element is rotated to release the keeper from the home position.

6. The electric door assembly of claim 1, further comprising an embedded door controller that is activated by a user via a user interface to force rotation of the blocking element.

7. The electric door assembly of claim 6, further comprising a timer, wherein the timer is integrated with the controller to control the actuator to release or actuate the blocking element back into the home position after a predetermined amount of time.

8. The electric door assembly of claim 6, further comprising a sound device connected to the controller for providing a selectable option of sound generation to differentiate when power is being supplied to the actuator assembly.

9. The electric door assembly of claim 1, further comprising a latch monitoring device to monitor the position of a latch bolt in a latch cavity formed by the keeper and the housing.

10. A locking system comprising:

a door assembly having a latch;

a door frame for mounting the door assembly; and an electric strike assembly mounted in the door frame and configured to receive the latch, the strike assembly comprising:

a housing formed with a recessed portion therein;

a keeper pivotally arranged in the recessed portion of the housing, the keeper having an abutment, the keeper including a keeper bar extending longitudinally between two axle hubs, and the keeper including two pivot pins with one pivot pin extending distally from each of the two axle hubs and defining an axis of rotation;

an actuator assembly having an actuator and an actuator paddle;

a blocking element rotatably mounted in the recessed portion of the housing, the blocking element including a paddle arm extending from a mounting hub with the actuator paddle cooperating with the paddle arm to rotate the blocking element about the mounting hub, and the blocking element including a blocking arm configured to wedge below the abutment on the keeper when the keeper is in the home position, wherein cooperation of the actuator paddle with the blocking element is controlled by rotation of the actuator, a locking condition of the keeper being determined based on a rotational position of the blocking element with respect to the abutment; and a return spring, wherein the blocking arm includes a return spring mount for compression mounting the return spring between a portion of the housing and the return spring mount, and the return spring rotatably biasing the blocking element toward the keeper.

11. The locking system of claim 10, further comprising a latch monitoring device to monitor the position of the latch in a latch cavity formed by the keeper and the housing.

12. A method of controlling access through a door, the method comprising:

providing an electric strike assembly having a housing, a keeper pivotally mounted to the housing, a blocking element rotatably mounted in the housing, and an actuator assembly having an actuator and an actuator paddle; and actuating the actuator paddle with the actuator to rotate into engagement with the blocking element, wherein the blocking element disengages from the abutment allowing the keeper to pivot open from a home position, wherein the keeper is pivotally arranged in the recessed portion of the housing, the keeper has an abutment, the keeper includes a keeper bar extending longitudinally between two axle hubs, and the keeper includes two pivot pins with one pivot pin extending distally from each of the two axle hubs and defining an axis of rotation;

the blocking element is rotatably mounted in the recessed portion of the housing, the blocking element includes a paddle arm extending from a mounting hub with the actuator paddle cooperating with the paddle arm to rotate the blocking element about the mounting hub, and the blocking element includes a blocking arm configured to wedge below the abutment on the keeper when the keeper is in the home position, wherein cooperation of the actuator paddle with the blocking element is controlled by rotation of the actuator, and a locking condition of the keeper is determined based on a rotational position of the blocking element with respect to the abutment; and a return spring, wherein the blocking arm includes a return spring mount for compression mounting the return spring between a portion of the housing and the return spring mount, and the return spring rotatably biasing the blocking element toward the keeper.

13. The method of claim 12, further comprising:

biasing the keeper toward the home position.

14. The method of claim 13, further comprising:

biasing the blocking element into engagement with the abutment on the keeper.

15. The method of claim 14, further comprising:

providing a controller activated by a user via a user interface to control the actuation of the strike assembly between a locked state and an open state.

* * * * *